US011340032B2

(12) United States Patent
Wilkinson

(10) Patent No.: US 11,340,032 B2
(45) Date of Patent: May 24, 2022

(54) AMMUNITION PACKAGING AND LOADING DEVICE CALLED A PAC AND LOAD

(71) Applicant: Steve Wilkinson, Bedford, IN (US)

(72) Inventor: Steve Wilkinson, Bedford, IN (US)

( * ) Notice: Subject to any disclaimer, the term of this patent is extended or adjusted under 35 U.S.C. 154(b) by 164 days.

(21) Appl. No.: 16/586,962

(22) Filed: Sep. 28, 2019

(65) Prior Publication Data

US 2020/0064093 A1 Feb. 27, 2020

Related U.S. Application Data

(63) Continuation-in-part of application No. 15/948,182, filed on Apr. 9, 2018, now abandoned.

(51) Int. Cl.
*F41A 9/84* (2006.01)

(52) U.S. Cl.
CPC ..... *F41A 9/84* (2013.01)

(58) Field of Classification Search
CPC ..... F41A 9/84; F41A 9/82; F41A 9/83
See application file for complete search history.

(56) References Cited

U.S. PATENT DOCUMENTS 356,276 A * 1/1887 Diss ..... F41A 9/84 42/88
391,811 A * 10/1888 Mixter ..... F41A 9/83 42/87
606,021 A * 6/1898 Parkhurst ..... F41A 9/84 42/88
606,058 A * 6/1898 Honiss ..... F41A 9/84 42/88
676,371 A * 6/1901 Scott ..... F41A 9/84 42/88
719,254 A * 1/1903 Parkhurst ..... F41A 9/72 42/49.01
719,808 A * 2/1903 Johnson ..... F41A 9/83 42/87
794,680 A * 7/1905 Parkhurst ..... F41A 9/84 42/88
1,295,038 A * 2/1919 Johnson et al. ..... F41A 9/83 86/47
1,295,039 A * 2/1919 Johnson et al. ..... F41A 9/83 86/47
1,355,684 A * 10/1920 Northover ..... F41A 9/83 86/47
1,397,538 A * 11/1921 Nelson ..... F41A 9/83 86/47

(Continued)

*Primary Examiner* — Michelle Clement
(74) *Attorney, Agent, or Firm* — Ritchison Law Offices PC; John D Ritchison

(57) ABSTRACT

A Pack & Load ammunition packaging and loading device, containing thirty round, with a coupling mechanism for directly and mechanically loading ammunition rounds into standard rifle and pistol magazines. The device has a cup to engage the magazine and a pusher mechanism to quickly force the ammunition into the magazine as it mechanically feeds the round from the sleeve of the device made of a clam shell set of side rails coupled with a hinge on one side and interlocking teeth on the other. Filament brushes in the cup retain the ammunition and the device has a removable tab and slot to enable partial fills from the device. It eliminates the manual feed and quickly places the rounds into a standard magazine ready for use.

11 Claims, 23 Drawing Sheets

(56) References Cited

U.S. PATENT DOCUMENTS 1,840,477 A * 1/1932 Von Frommer ..... F41A 9/83 42/88
2,345,593 A * 4/1944 Garand ..... F41A 9/83 86/47
2,403,012 A * 7/1946 McPheters ..... F41A 9/83 86/47
2,451,521 A * 10/1948 Uglum ..... F41A 9/83 86/47
2,462,836 A * 3/1949 Barker ..... F41A 9/83 42/88
2,531,387 A * 11/1950 Bilodeau ..... F41A 9/83 86/46
2,659,173 A * 11/1953 Capito ..... F41A 9/84 42/87
2,783,570 A * 3/1957 Kunz ..... F41A 9/66 42/87
2,834,137 A * 5/1958 Kunz ..... F41A 9/83 42/87
2,856,720 A * 10/1958 Kunz ..... F41A 9/84 42/87
2,887,811 A * 5/1959 Johnson, Jr. ..... F41A 9/84 42/87
2,910,795 A * 11/1959 Agren ..... F41A 9/67 42/50
2,981,024 A * 4/1961 Skoff ..... F41A 9/83 42/87
3,045,525 A * 7/1962 Stadelmann ..... F42B 39/10 86/47
3,222,810 A * 12/1965 Musgrave ..... F41A 9/84 42/87
3,789,531 A * 2/1974 Kersten ..... F41A 9/65 42/87
3,906,652 A * 9/1975 Evans ..... F41A 9/66 42/50
4,121,365 A * 10/1978 Hodil ..... F42B 39/00 42/88
4,352,254 A * 10/1982 Peter ..... F41A 9/84 42/88
4,464,855 A * 8/1984 Musgrave ..... F41A 9/83 42/87
4,570,371 A * 2/1986 Mears ..... F41A 9/83 42/87
4,574,511 A * 3/1986 Csongor ..... F41A 9/84 42/87
4,614,052 A * 9/1986 Brown ..... F41A 9/83 42/50
4,688,344 A * 8/1987 Kim ..... F41A 9/83 42/50
4,706,402 A * 11/1987 Csongor ..... F41A 9/84 42/87
4,827,651 A * 5/1989 Conkey ..... F41A 9/83 42/87
4,829,693 A * 5/1989 Holmes ..... F41A 9/83 42/87
4,831,761 A 5/1989 Kulakow
4,939,862 A * 7/1990 Brandenburg ..... F41A 9/83 42/87
5,249,386 A * 10/1993 Switzer ..... F41A 9/83 42/87
5,402,594 A * 4/1995 Switzer ..... F41A 9/83 42/87
5,638,626 A 6/1997 Westrom
6,185,853 B1 * 2/2001 Sniezak ..... F41A 9/83 42/87
6,754,987 B1 * 6/2004 Cheng ..... F41A 9/83 42/87
6,810,616 B2 * 11/2004 Tal ..... F41A 9/83 42/87
7,059,077 B2 * 6/2006 Tal ..... F41A 9/83 42/88
7,093,386 B1 8/2006 Vieweg
7,533,483 B1 5/2009 Alzamora et al.
7,805,874 B2 * 10/2010 Tal ..... F41A 9/84 42/87
8,484,874 B2 * 7/2013 Kim ..... F41A 9/66 42/49.01
8,635,796 B2 1/2014 Fitzpatrick et al.
8,931,199 B1 * 1/2015 Cauley, Jr. ..... F41A 9/83 42/87
9,091,500 B1 * 7/2015 Kim ..... F41A 9/83
9,212,859 B1 * 12/2015 Tal ..... F41A 9/83
9,273,917 B1 * 3/2016 Buckner ..... F41A 9/83
9,618,286 B1 * 4/2017 Plate ..... F41A 9/83
9,644,910 B2 * 5/2017 Kim ..... F42B 39/002
9,689,633 B1 * 6/2017 Plate ..... F41A 9/83
9,772,152 B1 * 9/2017 Niccum ..... F41A 9/83
9,976,826 B2 * 5/2018 Hefer ..... F41A 9/83
D829,293 S * 9/2018 Hefer ..... D22/108
10,126,077 B1 * 11/2018 Glover ..... F41A 9/83
10,132,582 B1 * 11/2018 Zhou ..... F41A 9/83
10,139,176 B1 * 11/2018 Witecha ..... F41A 9/84
10,145,635 B2 * 12/2018 Hefer ..... F41A 9/83
10,151,547 B1 * 12/2018 Plate ..... F41A 9/83
10,175,017 B2 * 1/2019 Cottrell ..... F41A 9/83
10,222,155 B2 * 3/2019 Hefer ..... F41A 9/84
10,240,878 B1 * 3/2019 Hefer ..... F41A 9/83
D861,822 S * 10/2019 Hellyar ..... D22/108
10,598,455 B2 * 3/2020 Plate ..... F41A 9/83
10,612,873 B1 * 4/2020 Witecha ..... F41A 9/83
10,845,144 B1 * 11/2020 Witecha ..... F41A 9/84
2004/0020096 A1 * 2/2004 Tal ..... F41A 9/83 42/87
2005/0081421 A1 * 4/2005 Guy ..... F41A 9/83 42/88
2007/0157501 A1 * 7/2007 Cammenga ..... F41A 9/67 42/87
2009/0044440 A1 * 2/2009 Tal ..... F41A 9/84 42/87
2009/0288326 A1 * 11/2009 Twardy ..... F41A 9/83 42/87
2012/0192477 A1 * 8/2012 Kim ..... F41A 9/83 42/87
2013/0061505 A1 * 3/2013 Faifer ..... F41A 9/83 42/87
2013/0067788 A1 * 3/2013 Gray ..... F41A 9/84 42/88
2013/0232843 A1 * 9/2013 Bajuelo ..... F41A 9/83 42/87
2014/0298704 A1 * 10/2014 Niccum ..... F41A 9/83 42/87
2014/0317985 A1 * 10/2014 Cauley, Jr ..... F41A 9/83 42/87
2015/0377573 A1 * 12/2015 Niccum ..... F41A 9/83 42/87
2017/0051992 A1 * 2/2017 Cottrell ..... F41A 9/83
2017/0211902 A1 * 7/2017 Mills ..... F41A 9/83
2018/0087856 A1 * 3/2018 Hefer ..... F41A 9/83
2018/0292152 A1 * 10/2018 Wilkinson ..... F41A 9/83
2019/0017763 A1 * 1/2019 Roe ..... F41A 9/83
2020/0064093 A1 * 2/2020 Wilkinson ..... F41A 9/70
2020/0182570 A1 * 6/2020 Bian ..... F41A 9/83
2021/0116196 A1 * 4/2021 Weakly ..... F41A 9/83

* cited by examiner 200
210
212
220
222
224
225
229
230
235
235A
235B
240
250
255
260
270

221
228
229
240
220

221
224
228
222
220

221
229
228
226

221
224
226
222
220

228

226
228
221
229
220

222
229
228
224
221
220

228
229
226
225
229
220

228
229
225
226

222
226
224
221
220

41
42
44
43
40

63
64
61
63
62
65
60
64

52
53
54

75A
40
72
60
71
30.32

51
50
52
53

75A
40
72
60
71
30.32

120
40
72
60
80
71
30.32

Prototype single stack magazine 75
76
72

75A
42
44
43
72

63
64
62
65
66
61
60

62
67
63
60

67
61
64
65
60

63
61
64
60

41
40
44
42
43
41
45
43
40

45
40
41
46
44
45
40
45
42
43

Trigger Lock Magazine Assembly

All single stack and Pistol 83
84
86
85
82
87
81

96
80
82
84
83
87
81
88

82
85
87
130
88
86
120

120
81
85
86
31
130
88

125
120
WINCHESTER
126
126

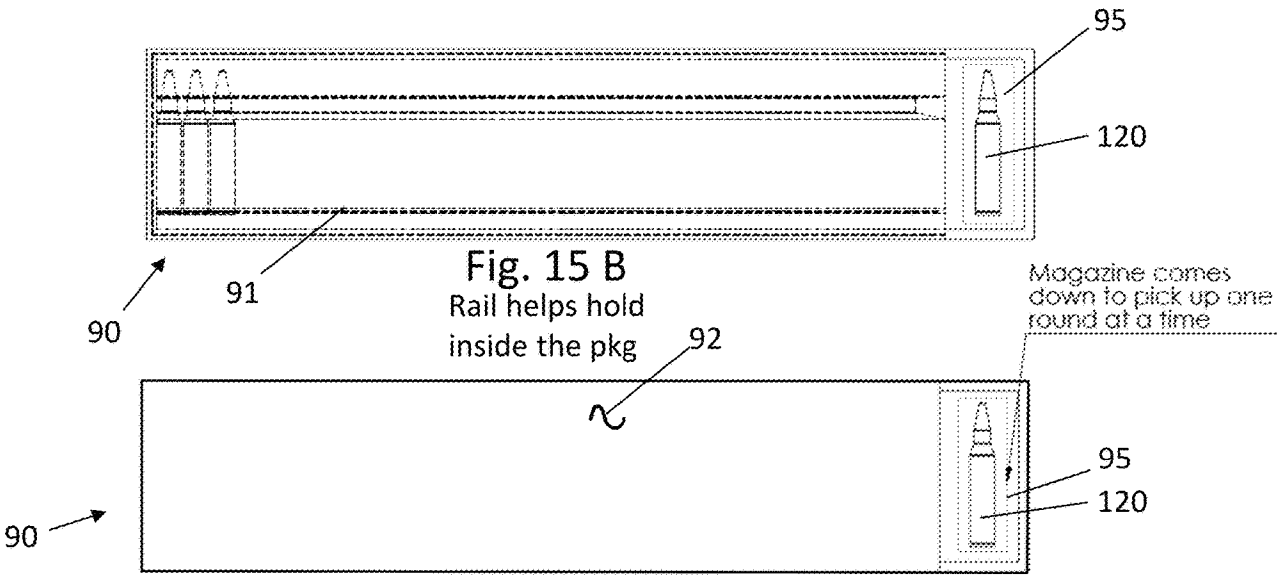
Fig. 15 B
Rail helps hold inside the pkg
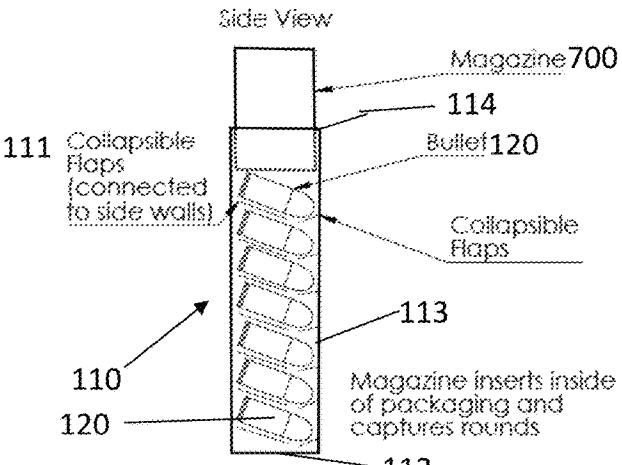
Fig. 15 A
Fig. 16 B
Single Stack
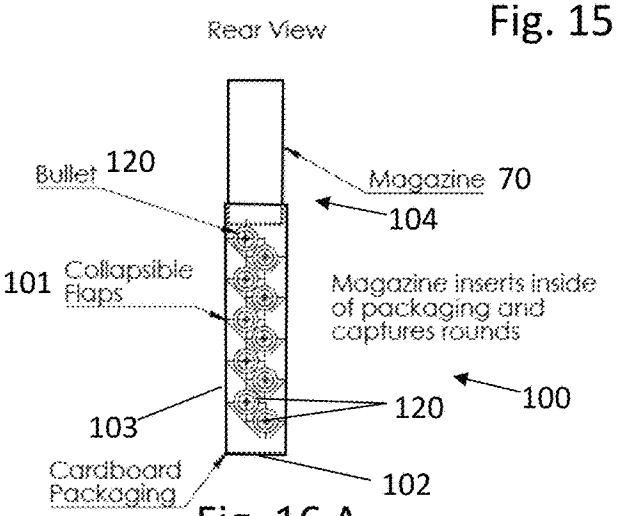
Fig. 16 A
Double Stack Machine Ammunition Loads -- air at side

290

AMMUNITION PACKAGING AND LOADING DEVICE CALLED A PAC AND LOAD

CROSS-REFERENCE TO RELATED APPLICATIONS

This application for an ammunition packaging and loading device called a Pack & Load is a Continuation-in-Part [C.I.P.] filed under 37 CFR 1.53(b) and claims the benefit of the original, non-provisional (Regular Utility) U.S. patent application Ser. No. 15/948,182 submitted Apr. 9, 2018 and published as US 2018/0292152 A1 on Oct. 11, 2018. The original application was still active on the date of the submission of this C.I.P. The original is entitled an "Internal and External locking/latching magazine device and coupling ammunition container called a "Lock and Load"" and was submitted by Steve Wilkinson, inventor. The original application is incorporated fully by reference as if it were reproduced here, verbatim. The original application claims the benefit of United States Provisional Patent Applications with Ser. No. 62/483,288 filed Apr. 7, 2017, by Steve Wilkinson and entitled "Internal locking/latching magazine device and coupling ammunition container called a "Lock and Load" and claims the benefit of United States Provisional Patent Applications with Ser. No. 62/575,574 filed Oct. 23, 2017, by Steve Wilkinson and entitled "Internal locking/latching magazine device and coupling ammunition container called a Lock and Load with an External Lock Option".

FIELD OF INVENTION

This invention relates to a cartridge package, and more particularly to a cartridge package which is inexpensive to make, attractive to display and convenient to use. This application relates generally to improvements in packaging ammunition or similar shaped products and, more specifically, to a package that protects its contents, can be used for multiple quantities, and is re-useable after it is initially opened. The present invention relates generally to packaging and more particularly to a container adapted for packaging a plurality of substantially cylindrical parts, for instance ammunition for firearms.

The alternative embodiments relate to an Internal and external locking/latching magazine device and a coupling ammunition container called a "Lock and Load" with an External Lock Option. The present invention relates in general to a device or apparatus for loading ammunition into a magazine. More particularly, the invention is concerned with a device or apparatus which provides for the rapid loading of ammunition into a magazine used for holding a number of rounds of ammunition. In addition, the present invention relates to a magazine loading system, and more particularly to a magazine loader mechanism which can quickly and easily load the ammunition into a magazine.

FEDERALLY SPONSORED RESEARCH

None.

SEQUENCE LISTING OR PROGRAM

None.

BACKGROUND-FIELD OF INVENTION AND PRIOR ART

As far as known, there are no ammunition packaging and loading devices or the like at this time of applying. There are also no known with an External Lock Option. It is believed that this product is unique in its design and technologies.

A. Background

Ammunition magazines are the most common means of storing and delivering ammunition into firearms. Firearms, including short weapons, assault rifles, and submachine guns, utilize and fire rounds (also known as cartridges and ammunition). Each round is substantially elongated and comprises a deep cup-like case (also known as a shell case and sometimes also a cartridge), usually of brass, which is filled with an explosive propellant. Traditionally, when loading a cartridge clip or magazine for a firearm, the cartridge (e.g. ammunition) must be manually loaded one at a time through an opening on a top portion of the cartridge clip. Generally, each cartridge is pressed against a previously loaded shell and a clip spring contained in the cartridge clip is compressed. As each shell is inserted, strain on the fingers may increase which may cause the individual's hand to become tired and many individuals may not have the required strength or dexterity to manually load the cartridge clip. Other individuals may only be able to partially load a cartridge clip due to the increased strength and dexterity required to continue to load the clip as the spring continues to be compressed. Alternatively, individuals who do have the required strength or dexterity to manually load a single cartridge into a clip may not have the strength to manually load multiple cartridge clips. Furthermore, resistance of the clip spring can slow the speed at which a clip is loaded.

Loading magazines with loose rounds is a relatively time-consuming, tedious, and painful practice if done with bare fingers. Pain accumulates and intensifies as more rounds are loaded against the increasing spring pressure, thus slowing the loading process. When a plurality of magazines are to be loaded, much time is required, which in turn shortens time for reposing, training, or combat time. In combat circumstances, slow reloading can be life-threatening.

The rounds are held within and fed into the firearm from a magazine. Detachable magazines have become dominant throughout the world. The term "magazine" is broad, encompassing several geometric variations, including curved magazines. Most detachable magazines are similar, varying in form and structure, rather than in their general principles of operation. Magazines usually take the form of an elongated container having a generally rectangular cross-section, which is attached to the underside of the firearm. Magazines are commonly made of aluminum alloys, plastic, steel, or a combination. They are usually closed on four or five sides and open on a sixth, upwardly facing, top, side or end, and are substantially hollow. The top open side has a rectangular opening and includes two round-retaining members, known as feed lips that project into or partly close the opening. An internal spring urges a follower or pusher (a shaped piece of plastic or metal) toward the open side. The follower in turn urges the rounds as a group up against the lips. The lips act as a stop for the rounds so that they are not expelled from the magazine. Within the magazine, the rounds are stacked or oriented in the magazine such that the longitudinal axes of the rounds are substantially parallel and perpendicular to the direction of travel of the spring and follower. Adjoining rounds are oriented side-by-side and in the same direction, i.e., the bullets of adjacent rounds are next to each other, as are the cases. Thus, the use of magazines is a convenient and effective method of feeding bullets, in rapid succession, into a weapon's firing chamber.

B. Problem Solved

On the other hand, as mentioned, the reloading of bullets into the spent magazine is known to be problematic. Thus a need is sought for a mechanism or device to be used and incorporated with the magazine so that the ammunition can be quickly and easy fed in the magazine. The loading of bullets into a magazine entails the progressive compression of the magazine spring. Initial loading may be accomplished without substantial manual effort while the latter stages of loading, by reason of increased spring resistance and internal friction, present a problem. Typically the bullet being loaded into the magazine is held by its nose and the base of the bullet used to depress the previously loaded bullet. Accordingly both substantial downward and inward pressure must be exerted on the bullet being loaded as it is slid into the clip or magazine. Handling of the projectile portion of the cartridge can increase misfires and jamming. In addition to the manual dexterity required, a degree of finger strength is necessary. Still further, the unaided loading of magazines is a tedious, time consuming task which consumes costly time when accomplished at a busy firing range. More particularly, the structural design of the magazine requires each bullet to be individually loaded through the top ejection end of the magazine past the retainers and downwardly against the force of the magazine spring (typically a compression spring or equal) in order to receive the bullet within the magazine. As each bullet is loaded, in sequence, the magazine spring in the magazine becomes progressively compressed until the magazine is fully loaded with bullets. Naturally, the resistance of the magazine spring (force) against the downward force of loading the bullets into the magazine becomes greater with each successive bullet loaded into the magazine. Thus, for many years, bullets have been loaded into empty magazines of firearms by hand, using the fingers to force each bullet downwardly against the force of the compression spring and into captured arrangement within the magazine. This process is time consuming, and quite often frustrating, on cold days when a person's fingers are numb, or are enclosed in a glove or mitten.

SUMMARY OF THE INVENTION

An ammunition packaging and loading device called a Pack & Load is comprised of simple parts designed and coordinated to work together. These parts include: rails, pusher, saddle center of pusher, teeth, brushes, cup, slot, hinge, a removable tab, and an alignment grid plus a paper, cardboard, cellophane or composite material wrapper with instructions, information, and a target. To be clear, an ammunition round or round is a complete round of ammo, the brass, cap, powder, and bullet. An alternative embodiment is an internal and external locking/latching loading device and coupling mechanism for directly and mechanically loading ammunition rounds into standard rifle and pistol magazines. The device has a latch and collar to engage the magazine and a push system to compress the magazine spring as it mechanically feeds the round from the ammunition sleeve of the device or straight from a contoured ammunition package which the collar of the device is press fit onto the surface of the ammunition package. It eliminates the manual feed and quickly places the rounds into a standard magazine ready for use.

The preferred embodiment of an ammunition packaging and loading device called a Pack & Load is an ammunition packaging and loading device made of durable materials and called a Pack & Load is comprised of: (a). pair of mirror imaged side rails each of the pair of side rails with a left and right side and a top pushing end and a bottom cup end and each of the pair further comprised with a living hinge and a channel along one side of the pair of side rails and a set of inter-lockable male and female snaps along the entire length of the opposite side of the pair of side-rails wherein on each of the snap sides is further comprised with a set of teeth flaps configured to engage with a pusher with a designed saddle shape in the center to secure one of the three fingers and wherein the bottom cup is further comprised with a slot opening; (b). the pusher for forcing the ammunition from the top end of the side-rails toward the bottom cup of the side-rails, the pusher further comprised with a sliding end configuration to engage the channel of the pair of sliding rails, an open aperture to engage the snaps of the pair of sliding rails, a saddle for a thumb of an operator to move the pusher, a flat member and a strengthening rib; and (c). a removable tab to be placed in the slot opening of the bottom cup for partial loading of a magazine wherein the ammunition packaging and loading device (called a "Pack & Load" utilize the pusher and rapidly fill the magazine with ammunition rounds.

An alternative embodiment of an Internal locking/latching magazine device and coupling ammunition container called a "Lock and Load" is comprised of (a) an exterior case of a traditional magazine and a spring of traditional magazine; (b) a modified follower (without stop post); (c) a trigger component further comprised of a top plate, a trigger post, a flat for latching of the trigger component to a base plate feature, and an aperture to connect to the spring; (d) a baseplate and trigger guard box further comprised of a slide configuration to slide ably interconnect guard box with magazine case, an aperture opening in guard box for trigger post, a base plate feature, and a trigger guard box; a push rod component; and (e) a contoured to ammunition package further comprised of sidewalls, an end, a means to secure the sidewalls, a stop/tab with an aperture, and a securing filament attached to the aperture in stop wing/tab, and an opening opposite the closed end is contoured for ammunition rounds wherein the Internal locking/latching magazine device and coupling ammunition container called a "Lock and Load" can disengage the spring by using the push rod to force down the ammunition rounds, engaging the trigger to lock with the baseplate and guard and hold the spring in compression so that the ammunition rounds can easily fall from the contoured package and into the magazine, and after the ammunition rounds are in the magazine case, the trigger can be released so the spring re-extends to hold the ammunition rounds against the top opening of the magazine.

Another alternative device is a collar or full sleeve. The collar is comprised of: (a) a rectangular collar that is configured to lightly press fit and encircle the perimeter of a contoured ammunition with an open end; (b) a tightening fastener to square the collar with an open end of a traditional ammunition magazine which has an aperture near the open end; and (c) a latch which can removably secure the collar to the aperture at the open end of the ammunition magazine wherein the collar is first placed onto the contoured package then latched to the open end of the magazine at the aperture, and then the package is pushed through the collar and into the open end of the magazine thus depressing the spring and releasing ammunition rounds into the magazine and filling the magazine. Still another alternative embodiment is an external locking/latching sleeve device comprised of: (a) a load base with and without extended support legs and a tab slot; (b) an external latch mechanism attached to the base; (c) a housing connected integrally at one end to the load base and at an opposite end to a cap and plate by fasteners; (d) a pusher plate encircling the housing; (e) at least one push rod attached at one end to the pusher plate with fasteners; (f) an optional horizontal rod attached to the pusher plate; and (g) a quick release tab wherein the device is aligned with an ammunition magazine at the open end of the magazine, then the latch of the device is engaged with an aperture of the magazine, then the push plate with the rods is pressed toward the magazine and a spring of the magazine is depressed as the ammunition rounds begin to release, next the pusher plate reaches the load base and all the rounds are completely released into the magazine thus filling the magazine full of ammunition rounds.

The newly invented ammunition packaging and loading device called a Pack & Load as well as the alternative Internal locking/latching magazine device and coupling ammunition container called a "Lock and Load" can be manufactured at low volumes by very simple means and in high volume production by more complex and controlled systems.

Objects and Advantages

There are several objects and advantages of the ammunition packaging and loading device called a Pack & Load as well as the internal locking/latching magazine device and coupling ammunition container called a "Lock and Load". There are currently no known ammunition containers and loaders that are effective at providing the objects of this invention.

The ammunition packaging and loading device called a Pack & Load has various advantages and benefits over a standard magazine:

| Item | Advantages |
|---|---|
| 1 | Pack & Load will hold 30 rounds of ammunition instead of 20 in giving a complete fill to an AR Magazine compared to box of 20 |
| 2 | Speed. One is able to load the ammunition many times faster. Compared to other loaders Pack & Load and Lock and load is one step load the magazine. |
| 3 | There will be no need for the user to touch the ammunition |
| 4 | The ammunition will go directly into the magazine, from the packaging, saving time and pressure on users fingers. |
| 5 | This is done at about the same price point as traditional packaging |
| 6 | Much less effort. Pack & Load gives your fingers three points to hold onto the pusher giving the user leverage on the rounds. |
| 7 | Reusable in storage and in loading. It can be reused in loading magazines and for transporting. |
| 8 | Ergonomic. As more and more of the population ages or have difficulty with strength in their hands and stress in joints. Now they can load a magazine without hurting their fingers. |
| 9 | Cost. The packaging is not a mechanism. It replaces all loading mechanisms which have a high cost between $40.00 to $150.00. This packaging will cost about the same as traditional packaging and gives the user a method to load ammo into the magazine at no additional cost over traditional boxes. |

-continued

| Item | Advantages |
|---|---|
| 10 | Fulfillment. The butterfly design will make fulfillment at the factory an easy process. The supplied grid system supplied to the factory will attach to the work station allowing the rounds to be held in place until the butterfly packaging is closed and removed. The grid system gives the packaging the capability to be fully automated. |
| 11 | Partial loads. The packaging allows the user to do partial loads. The teeth coming down the side of the packaging will hold the pusher from going back up, maintaining it as a cap. The removable tab will be placed in the slot, located in the cup, securing the rounds on the bottom for transportation. |
| 12 | The packaging can be used as a dispenser. In the case where a user does not have a double stacked opening magazine, the user can simply dispense the number of rounds they want out into their hand. This will be faster than removing them out of a box. The rounds will come out of the Pack & Load Packaging into the users hand lined up with cap and bullet facing the correct way. |
| 13 | Size advantage. Pack & Load can put sixty rounds in the same space that most traditional packages can only get 40. For shipping and store shelves, this will be an advantage to save space and money. |
| 14 | Wrapper. The wrapper that contains all of the directions and information for the Pack & Load packaging is also a free target that shooters can use in practice. It also come with glue tabs eliminating the need for tacks to secure the target up. |
| 15 | AR tool. A small pin will be manufactured onto the pusher. This pin will be used to press out the pins on the AR rifle for field stripping. Many of the shooters use a bullet for this job. Now this will be a safer and easier way to do this job. |
| 16 | Top brushes to be installed on the top of the packaging. They will be able to enclose down and around the empty brasserie loading them into the rails of the packaging for cleaning up the spent ammunition. |

Finally, other advantages and additional features of the present ammunition packaging and loading device called a Pack & Load and the alternative Internal locking/latching magazine device and coupling ammunition container called a "Lock and Load will be more apparent from the accompanying drawings and from the full description of the device. For one skilled in the art of firearms, magazines and loaders, it is readily understood that the features shown in the examples with this product are readily adapted to other types of out the magazine loaders and unloaders in the market today.

DESCRIPTION OF THE DRAWINGS—FIGURES

The accompanying drawings, which are incorporated in and constitute a part of this specification, illustrate an embodiment of the ammunition packaging and loading device called a Pack & Load Option that is preferred. The drawings together with the summary description given above and a detailed description given below serve to explain the principles of the improved magazine loading system and devices. It is understood, however, that the Lock and Load system is not limited to only the precise arrangements and instrumentalities shown.

1 A through 1 E are sketches of the general ammunition packaging and loading device called a Pack & Load and the alternative internal locking/latching magazine device and coupling ammunition container called a "Lock and Load".

FIGS. 2 A through 2 K are sketches of an ammunition packaging and loading device called a Pack & Load with components and features noted.

FIGS. 3 A through 3 I are more sketches of an ammunition packaging and loading device called a Pack & Load with components and features noted.

FIGS. 4 A through 4 D are isometric sketches of an ammunition packaging and loading device called a Pack & Load from an isometric with components and features noted.

FIGS. 5 A through 5 G are sketches of the two part clamshell of an ammunition packaging and loading device called a Pack & Load with components and features noted.

FIGS. 6 A through 6 J are sketches of pusher component of the ammunition packaging and loading device called a Pack & Load with components and features noted.

FIGS. 7 A through 7 G are sketches of a prototype Internal locking/latching magazine device and coupling ammunition container called a "Lock and Load" with components and features noted.

FIGS. 8 A through 8 D are sketches of a prototype Load and Lock with the components and features shown from front view.

FIGS. 9 A through 9 D are sketches of the base plate and trigger protection component with features shown from several views.

FIGS. 10 A through 10 C are sketches of the trigger component with features indicated and a trigger prototype shown.

FIGS. 11 A through 11 E are sketches of the components and assembly comprising the Internal locking/latching magazine device and coupling ammunition container called a "Lock and Load".

FIGS. 12 A and 12 B are sketches and a prototype of a typical ammunition magazine with features and components shown from a generally front view.

FIGS. 13 A through 13 E are sketches that portray a contoured ammunition package and the improved magazine coupled together.

FIGS. 14 A through 14 C are more sketches of the contoured ammunition package.

FIGS. 15 A and 15 B are sketches of a single round loading ammunition package to be coupled with the Internal locking/latching magazine device called a "Lock and Load" with an External Lock Option.

FIGS. 16 A and 16 B are sketches of both a single stack and double stack ammunition package to be coupled with the Internal locking/latching magazine device called a "Lock and Load" with an External Lock Option.

FIGS. 17 A and 17 B are sketches of the External locking/latching magazine device and coupling ammunition container.

FIGS. 18 A through 18 H are prototypes and sketches of the External locking/latching magazine device and coupling ammunition container.

FIGS. 19, 19 LL, and 19 FF are sketches of an ammunition loading machine with the External locking/latching magazine device and coupling ammunition container.

FIGS. 20 A, 20 B and 20 FF are sketches of the alignment guide and manufacturing ease for assembly into the clamshell Pack & Load device.

Figure 23C:
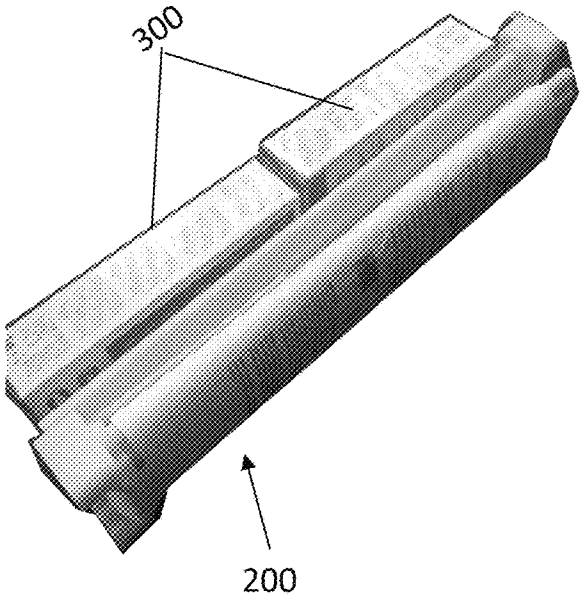
Figure 23B:
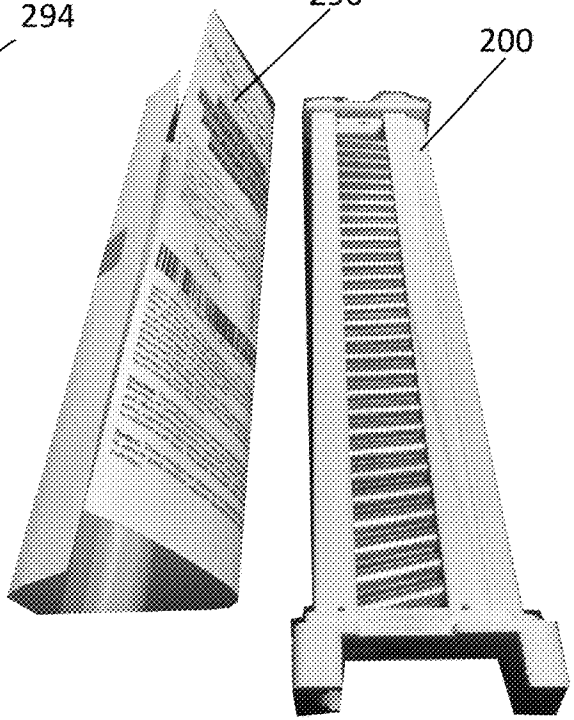
Figure 23A:
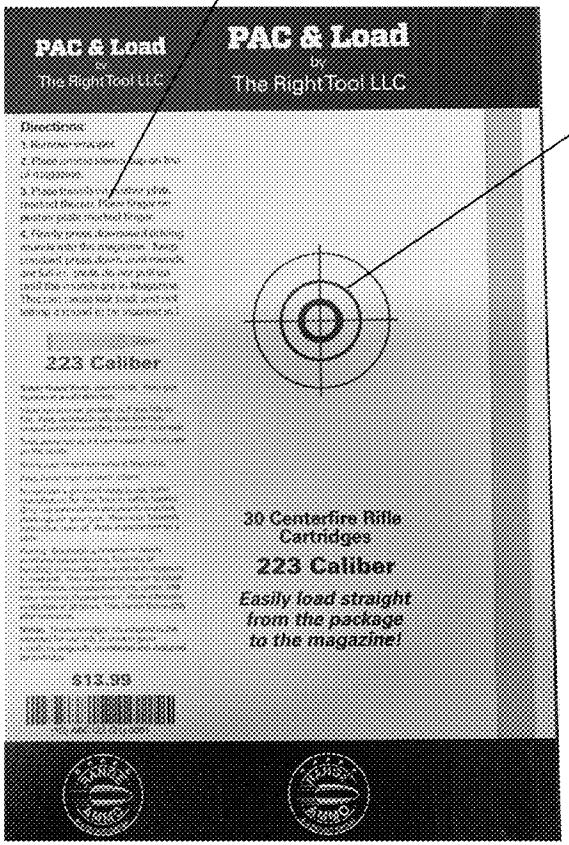

FIGS. 23 A through 23 C are sketches of Pack & Load device with the wrapper and comparison to typical ammunition boxes.

DESCRIPTION OF THE DRAWINGS—REFERENCE NUMERALS

The following list refers to the drawings:

TABLE B

Reference numbers

| Ref # | Description |
|---|---|
| 30 | Internal locking/latching magazine device and coupling ammunition container called a "Lock and Load" 30 |
| 31 | prototype sample 31 of Internal locking/latching magazine device and coupling ammunition container called a "Lock and Load" 30 |
| 32 | drawings 32 of Internal locking/latching magazine device and coupling ammunition container called a "Lock and Load" 30 |
| 40 | trigger component 40 of the Internal locking/latching magazine device and coupling ammunition container called a "Lock and Load" 30 |
| 41 | top plate 41 of the trigger component 40 |
| 42 | trigger post 42 of the trigger component 40 |
| 43 | contour 43 for finger of the trigger component 40 to release ammunition and latch on the device 30 |
| 44 | flat 44 for latching of the trigger component 40 to the base plate 63 on the device 30 |
| 45 | gussets 45 of the trigger component 40 |
| 46 | aperture 46 for end of spring 72 in the trigger component 40 |
| 50 | push rod component 50 of the improved magazine loader device 30 |
| 51 | rod handle 51 |
| 52 | rod post 52 |
| 53 | post extender 53 at 90 degrees/perpendicular to rod post 52 |
| 54 | round contour 54 to match with contour of ammunition round 120 |
| 60 | baseplate and trigger guard box 60 |
| 61 | slide configuration 61 to slide ably interconnect guard box 60 with magazine case 71 |
| 62 | aperture opening 62 in guard box 60 for trigger 44 |
| 63 | base plate 63 baseplate and trigger guard box 60 |
| 64 | parallel sides 64 of baseplate and trigger guard box 60 |
| 65 | bottom 65 of baseplate and trigger guard box 60 |
| 66 | interior space 66 of baseplate and trigger guard box 60 |
| 67 | spring ear 67 of baseplate and trigger guard box 60 |
| 70 | traditional magazine 70 |
| 71 | exterior case 71 of traditional magazine 70 |
| 72 | spring 72 of traditional magazine 70 |
| 73 | base plate 73 of a traditional magazine 70 |
| 74 | slide configuration 74 to slide ably interconnect case 71 of traditional magazine 70 to base plate 73 |
| 75 | follower 75 of traditional magazine 70 |
| 75A | follower 75A (without stop post 76) of internal device 30 |
| 76 | stop post 76 of follower 75 |
| 77 | aperture 77 in follower 75 for plate end of spring 72 |
| 78 | universal aperture 78 at load end/top of magazine 70 for receiving external latch mechanisms (external latch tab 143 and screw latch 151) |
| 80 | contoured to ammunition package 80 |
| 80T | top 80T of contoured to ammunition package 80 |
| 80B | bottom 80B of contoured to ammunition package 80 |
| 81 | aperture/slot, or slit, 81 for stop wing/tab 85 |
| 82 | packaging sidewalls 82 of contoured to ammunition package 80 |
| 82A | packaging stop 82A below the collar 89 to easily get to the rounds and force them toward the magazine 70. |
| 82B | slice/opening perforation 82B to easily get to the rounds and force them toward the magazine 70. |
| 82C | movable section 82C (like a collapsible soda straw) to turn and fit a curved magazine |
| 83 | crimped or glued end 83 of contoured to ammunition package 80 |
| 84 | means 84 for securing crimped end 83 and two sidewalls 82 |

TABLE B-continued

Reference numbers

| Ref # | Description |
|---|---|
| | to create an open ended envelop or sleeve contoured to ammunition rounds 120 crimp, adhesive, sonic weld, staple or the like |
| 85 | stop wing/tab 85 |
| 86 | aperture 86 in stop wing/tab 85 for securing filament/fiber/wire/string/or equal 88 |
| 87 | open contour 87 contiguous to rounds 120 |
| 88 | securing filament/fiber/wire/string/strap or equal 88 |
| 89 | external latching cuff/collar 89 to accept packaging 80 and then, in combination with packaging 80, push down and load ammunition rounds 120 directly into magazine 70 or sleeves |
| 90 | ammunition loading package 90 for single round 120 loading into Internal locking/latching magazine device and coupling ammunition container called a "Lock and Load" 30 |
| 91 | round holding and guiding configuration/ledges 91 |
| 92 | package surface 92 |
| 95 | pocket 95 for single rounds 120 |
| 100 | ammunition loading package 100 for double stacked rounds 120 |
| 101 | collapsible flaps 101 |
| 102 | closed end 102 |
| 103 | closed sides 103 |
| 104 | openable end 104 |
| 110 | ammunition loading package 110 for single stacked rounds 120 |
| 111 | collapsible flaps 111 |
| 112 | closed end 112 |
| 113 | closed sides 113 |
| 114 | openable end 114 |
| 120 | ammunition round 120 |
| 125 | typical box/container 125 for ammunition rounds 120 |
| 126 | rounds holder 126 such as Styrofoam with recessed holes/pocket for each round 120 |
| 130 | individual operator/hand 130 |
| 140 | external latch 140 for cuff/collar device 89—may be metal, steel, spring steel, plastic, composite material easy to form with spring properties |
| 141 | end keeper angle 141 of external latch 140 |
| 143 | external latch tab 143 that engages universal aperture 78 on magazine 70 |
| 144 | external locking/latching sleeve device 144 and coupling ammunition container called a "Lock and Load" 144 with extended support legs 153 |
| 144A | external locking/latching sleeve device 144A and coupling ammunition container called a "Lock and Load" 144 without extension support |
| 145 | internal cross rod 145 of external latching sleeve devices 144, 144A to maintain pressure on the ammunition rounds 120 at a slight angle |
| 146 | external rod 146 of external latching sleeve devices 144, 144A (at least one or up to three vertical rods aligning magazine 70 with sleeve 144, 144A during push down on ammunition rounds 120) |
| 150 | outside screw 150 presses tightly against walls 82 to adjust the opening size 87 needed to hold the package 80 and the magazine 70 square to each other and keep openings in each 70, 80 (87) in line for the ammunition rounds 120 to pass easily |
| 151 | outside follower button 151 of collar 89, the button 151 engages the aperture 78 of the magazine 70 during loading |
| 152 | load base 152 with external leg/extensions 153 features of external locking/latching sleeve device 144 |
| 152A | load base 152A of external locking/latching sleeve device 144A with no extensions |
| 153 | external leg/extensions 153 feature to hold rods 146, 145 |
| 154 | housing 154 portion between load base 152, 152A and sleeve cap and plate 157 |
| 155 | essentially rectangular structure 155 of external latch collar 89 holding pressure button 150 and latch 151 |
| 156 | push plate 156 with external leg/extensions 153 features |
| 156A | push plate 156A with no extensions |
| 157 | sleeve cap and plate 157 |
| 158 | one or more fasteners 158 for sleeve cap 157 |
| 159 | one or more fasteners 159 for rods 146, 145 |

TABLE B-continued

Reference numbers

| Ref # | Description |
|---|---|
| 160 | ammunition package filling machine 160 |
| 165 | powered and timed roller conveyor 165 |
| 170 | box stop 170 |
| 175 | ammunition pneumatic air pressured round loader 175 |
| 180 | top 80T closer and securing to bottom 80B mechanism at station 180 of the machine 160 |
| 185 | sheet loader station 185 |
| 190 | external latch automatic unload station 190 |
| 200 | Pack & Load ammunition packaging and loading device 200 holding thirty ammunition rounds 120 and made of a durable material such as polyurethane plastic or the like |
| 205 | open clamshell 205 of the Pack & Load ammunition packaging and loading device 200 with a living hinge 230 joining two sides of rails 210 |
| 210 | rails 210 that hold the ammunition rounds 120 and act as tracks for the rounds 120 to slide through. |
| 212 | channel 212 configured to sliding retain pusher 220 sliding end configuration 222 |
| 220 | pusher 220 is the mechanism that pushes the ammunition rounds 120 into the magazine 70 |
| 221 | small pin 221 on the pusher 220 used to press out the pins on the AR rifle for field stripping |
| 222 | sliding end configuration 222 to engage channel 212 of rails 210 |
| 224 | open aperture configuration 224 to contain snapped end of rails 210 |
| 226 | saddle 226 for thumb to push and move pusher 220 |
| 228 | strengthening rib 228 of pusher 220 |
| 229 | flat member 229 of pusher 220 |
| 225 | set of teeth (tooth) 225 keeps the pusher 220 from going back up the rails 210 and holds the rounds 120 if a particle fill is used. |
| 230 | living hinge 230 which is on the bullet or lead side rail 210, will allow the packaging 200 to open, it is described as a living hinge which means that it is flexible enough to be opened and closed, with optional holdback male and female snaps. |
| 235 | snaps 235 are male snaps 235A and female snaps 235B running like a zipper all the way up and down the rail 210 that is opposite of the hinge 230 |
| 240 | cup 240 is the base that goes around the magazine 70 |
| 245 | aperture 245 in cup 240 to receive and inter connect with interference fit to magazine 70 |
| 250 | bottom brushes 250 hold the rounds 120 in place after the removable tab 260 is peeled away. With pressure, the rounds 120 pass by them into the magazine 70 |
| 255 | top brushes 255 hold the spent brass from rounds 120 in place after the Pack & lock 120 is emptied and inverted, then with pressure, the brass pass by the top brush 255 into the open space between the rails 210 |
| 260 | removable tab 260 is a small strip of plastic or equal that holds all the rounds 120 in place during transport and will then be placed into the slot. |
| 270 | slot 270 is the opening for the removable tab 260 to go into if there is a partial load to hold leftover rounds 120 in the Pack & Load packaging 200 |
| 280 | alignment grid 280, used while filling the Pack & Load 200 during manufacturing, are small pieces of plastic that are spaced about the same width as the rounds 120, within the thirty (30) grids, enough for each round 120 |
| 282 | slot 282 for ammunition rounds 120 |
| 290 | wrapper 290 for Pack & Load ammunition packaging and loading device 200 |
| 292 | instructions 292 on wrapper 290 |
| 294 | printed target 294 on wrapper with means such as sticky tabs to attach target to flat surface |
| 300 | typical and traditional twenty round ammunition box 300 |

DETAILED DESCRIPTION OF PREFERRED EMBODIMENT

The present preferred development is an ammunition packaging and loading device called a Pack & Load. This invention relates to a cartridge package, and more particularly to a cartridge package which is inexpensive to make, attractive to display and convenient to use. This application relates generally to improvements in packaging ammunition or similar shaped products and, more specifically, to a package that protects its contents, can be used for multiple quantities, and is re-useable after it is initially opened. The present invention relates generally to packaging and more particularly to a container adapted for packaging a plurality of substantially cylindrical parts, for instance ammunition for firearms. This invention relates to a cartridge package, and more particularly to a cartridge package which is inexpensive to make, attractive to display and convenient to use. This application relates generally to improvements in packaging ammunition or similar shaped products and, more specifically, to a package that protects its contents, can be used for multiple quantities, and is re-useable after it is initially opened. The present invention relates generally to packaging and more particularly to a container adapted for packaging a plurality of substantially cylindrical parts, for instance ammunition for firearms.

The alternative development is an Internal locking/latching magazine device and coupling ammunition container called a "Lock and Load" with an External Lock Option. This alternative invention relates to an Internal locking/latching magazine device and coupling ammunition container called a "Lock and Load". The present invention relates in general to a device or apparatus for loading ammunition into a magazine. More particularly, the invention is concerned with a device or apparatus which provides for the rapid loading of ammunition into a magazine used for holding a number of rounds of ammunition. In addition, the present invention relates to a magazine loading system, and more particularly to a magazine loader mechanism which can quickly and easily load the ammunition into a magazine.

The advantages of the ammunition packaging and loading device called a Pack & Load 200 and the alternative Internal locking/latching magazine device and coupling ammunition container called a "Lock and Load" 30 and the External locking/latching magazine device 89, 144, 144A and coupling ammunition container 80 are listed above in the introduction. Succinctly the benefits are that the device:

A. Pack & Load will hold 30 rounds of ammunition instead of 20 in giving a complete fill to an AR Magazine compared to box of 20;

B. Speed. One is able to load the ammunition many times faster. Compared to other loaders Pack and Load and Lock and load is one step load the magazine;

C. There will be no need for the user to touch the ammunition;

D. The ammunition will go directly into the magazine, from the packaging, saving time and pressure on users fingers.

E. This is done at about the same price point as traditional packaging;

F. Much less effort. Pack and Load gives your fingers three points to hold onto the pusher giving the user leverage on the rounds;

G. Reusable in storage and in loading. It can be reused in loading magazines and for transporting;

H. Ergonomic. As more and more of the population ages or have difficulty with strength in their hands and stress in joints. Now they can load a magazine without hurting their fingers;

I. Cost. The packaging is not a mechanism. But it replaces all loading mechanisms which have a high cost between $40.00 to $150.00. This packaging will cost about the same as traditional packaging and gives the user a method to load ammo into the magazine at no additional cost over traditional boxes;

J. Fulfillment. The butterfly design will make fulfillment at the factory an easy process. The supplied grid system supplied to the factory will attach to the work station allowing the rounds to be held in place until the butterfly packaging is closed and removed. The grid system gives the packaging the capability to be fully automated;

K. Partial loads. The packaging allows the user to do partial loads. The teeth coming down the side of the packaging will hold the pusher from going back up, maintaining it as a cap. The removable tab will be placed in the slot, located in the cup, securing the rounds on the bottom for transportation.

L. The packaging can be used as a dispenser. In the case where a user does not have a double stacked opening magazine, the user can simply dispense the number of rounds they want out into their hand. This will be faster than removing them out of a box. The rounds will come out of the Pack & Load Packaging into the users hand lined up with cap and bullet facing the correct way;

M. Size advantage. Pack & Load can put sixty rounds in the same space that most traditional packages can only get 40. For shipping and store shelves, this will be an advantage to save space and money;

N. Wrapper. The wrapper that contains all of the directions and information for the Pack & Load packaging is also a free target that shooters can use in practice; it also come with glue tabs eliminating the need for tacks to secure the target up.

O. AR tool. A small pin will be manufactured onto the pusher. This pin will be used to press out the pins on the AR rifle for field stripping. Many of the shooters use a bullet for this 15job. Now this will be a safer and easier way to do this job; and P. Top brushes to be installed on the top of the packaging. They will be able to enclose down and around the empty brasserie loading them into the rails of the packaging for cleaning up the spent ammunition.

The preferred embodiment of an ammunition packaging and loading device called a Pack & Load is an ammunition packaging and loading device (200) made of durable materials and called a Pack and Load is comprised of: (a). pair of mirror imaged side rails (210) each of the pair of side rails with a left and right side and a top pushing end and a bottom cup (240) end and each of the pair further comprised with a living hinge (230) and a channel (212) along one side of the pair of side rails and a set of inter-lockable male and female snaps (235) along the entire length of the opposite side of the pair of side-rails wherein on each of the snap sides is further comprised with a set of teeth flaps (225) configured to engage with a pusher (220) and wherein the bottom cup (240) is further comprised with a slot (270) opening; (b). the pusher (220) for forcing the ammunition from the top end of the side-rails toward the bottom cup (240) of the side-rails, the pusher further comprised with a sliding end configuration (222) to engage the channel (212) of the pair of sliding rails, an open aperture (224) to engage the snaps (235) of the pair of sliding rails, a saddle (226) for a thumb of an operator to move the pusher, a flat member (229) and a strengthening rib (228); and (c). a removable tab (260) to be placed in the slot opening (270) of the bottom cup (240) for partial loading of a magazine (70) wherein the ammunition packaging and loading device (200) called a "Pack & Load" utilize the pusher (220) and rapidly fill the magazine (70) with ammunition rounds (120).

The alternative embodiment of an Internal locking/latching magazine device and coupling ammunition container called a "Lock and Load" 30 is comprised of (a) an exterior case of a traditional magazine and a spring of traditional magazine; (b) a modified follower (without stop post); (c) a trigger component further comprised of a top plate, a trigger post, a flat for latching of the trigger component to a base plate feature, and an aperture to connect to the spring; (d) a baseplate and trigger guard box further comprised of a slide configuration to slide ably interconnect guard box with magazine case, an aperture opening in guard box for trigger post, a base plate feature, and a trigger guard box; a push rod component; and (e) a contoured to ammunition package further comprised of sidewalls, an end, a means to secure the sidewalls, a stop/tab with an aperture, and a securing filament attached to the aperture in stop wing/tab, and an opening opposite the closed end is contoured for ammunition rounds wherein the Internal locking/latching magazine device and coupling ammunition container called a "Lock and Load" can disengage the spring by using the push rod to force down the ammunition rounds, engaging the trigger to lock with the baseplate and guard and hold the spring in compression so that the ammunition rounds can easily fall from the contoured package and into the magazine, and after the ammunition rounds are in the magazine case, the trigger can be released so the spring re-extends to hold the ammunition rounds against the top opening of the magazine.

Another alternative device is a collar or full sleeve. The collar is comprised of: (a) a rectangular collar that is configured to lightly press fit and encircle the perimeter of a contoured ammunition with an open end; (b) a tightening fastener to square the collar with an open end of a traditional ammunition magazine which has an aperture near the open end; and (c) a latch which can removably secure the collar to the aperture at the open end of the ammunition magazine wherein the collar is first placed onto the contoured ammunition package then latched to the open end of the magazine at the aperture, and then the package is pushed through the collar and into the open end of the magazine thus depressing the spring and releasing ammunition rounds into the magazine and filling the magazine.

Still another alternative embodiment is an external locking/latching sleeve device comprised of: (a) a load base with and without extended support legs and a tab slot; (b) an external latch mechanism attached to the base; (c) a housing connected integrally at one end to the load base and at an opposite end to a cap and plate by fasteners; (d) a pusher plate encircling the housing; (e) at least one push rod attached at one end to the pusher plate with fasteners; (f) an optional horizontal rod attached to the pusher plate; and (g) a quick release tab wherein the device is aligned with an ammunition magazine at the open end of the magazine, then the latch of the device is engaged with an aperture of the magazine, then the push plate with the rods is pressed toward the magazine and a spring of the magazine is depressed as the ammunition rounds begin to release, next the pusher plate reaches the load base and all the rounds are completely released into the magazine thus filling the magazine full of ammunition rounds.

There is shown in FIGS. 1-23 a complete description and operative embodiment of the ammunition packaging and loading device 200 called a Pack & Load and the Internal locking/latching magazine device and coupling ammunition container called a "Lock and Load" with an External Lock Option. In the drawings and illustrations, one notes well that the FIGS. 1-23 demonstrate the general configuration and use of this system. The various example uses are in the operation and use section, below.

The accompanying drawings, which are incorporated in and constitute a part of this specification, illustrate an embodiment of an ammunition packaging and loading device 200 called a Pack & Load and alternatives such as an Internal locking/latching magazine device and coupling ammunition container called a "Lock and Load" 30 and an external lock 89, 144, 144A compatible with most rifle and pistol type magazines. The drawings together with the summary description given above and a detailed description given below serve to explain the principles of the Pack & Load 200 and the alternative Lock and Load 30, 89, 144, 144A. It is understood, however, that embodiments 200, 30, 89, 144, 144A are not limited to only the precise arrangements and instrumentalities shown. Other examples of magazines and loader devices and uses are still understood by one skilled in the art of ammunition magazine loaders and packaging devices to be within the scope and spirit shown here.

FIGS. 1 A through 1 E are sketches of the general Internal locking/latching magazine device and coupling ammunition container called a "Lock and Load" 30. In these drawings are shown the general system and components including: the ammunition packaging and loading device called a Pack & Load 200; the Internal locking/latching magazine device and coupling ammunition container called a "Lock and Load" 30; prototype sample 31 of Internal locking/latching magazine device and coupling ammunition container called a "Lock and Load" 30; trigger component 40 of the Internal locking/latching magazine device and coupling ammunition container called a "Lock and Load" 30; a push rod component 50 of the improved magazine loader device 30; baseplate and trigger guard box 60; follower 75A (without stop post 76) of new device 30; contoured to ammunition package 80; ammunition round 120; and individual operator/hand 130.

Figure 1D:
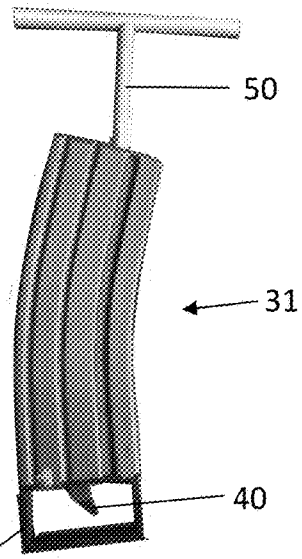
Figure 1E:
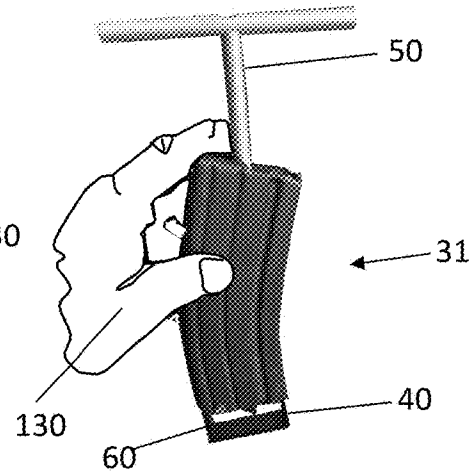
Figure 1C:
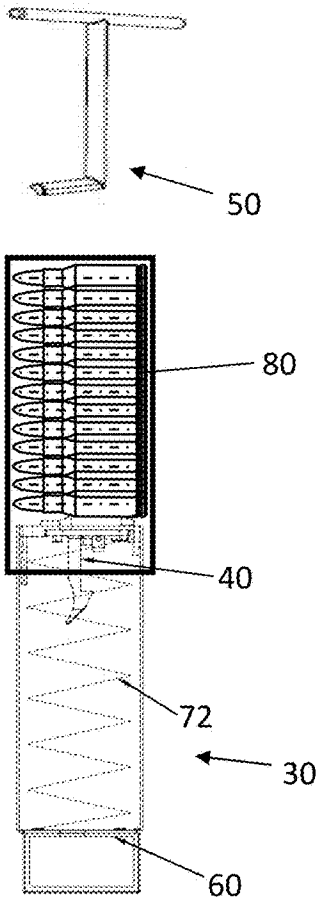
Figure 1B:
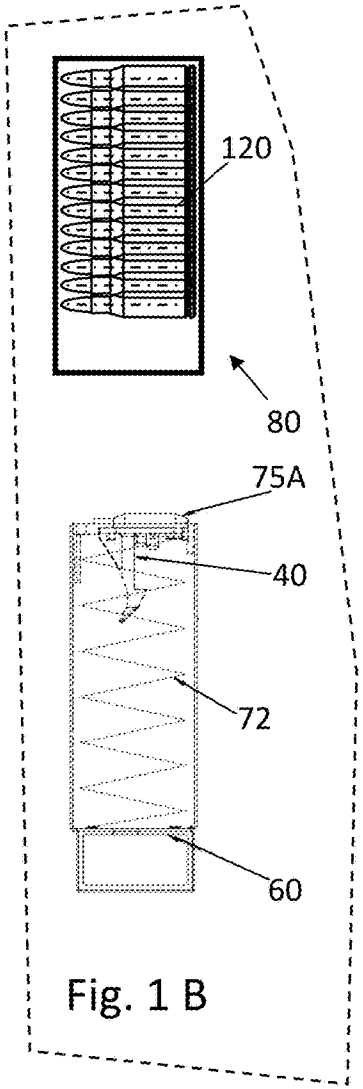
Figure 1A:
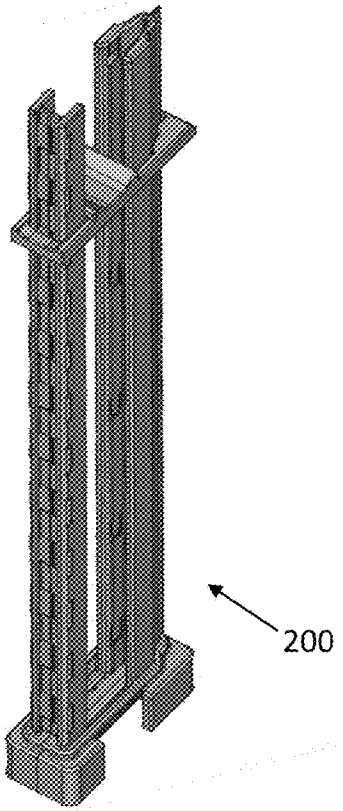
Figures 2A, 2B, 2C, 2D, 2E, 2F, 2G, 2H, 2I, 2J, 2K:
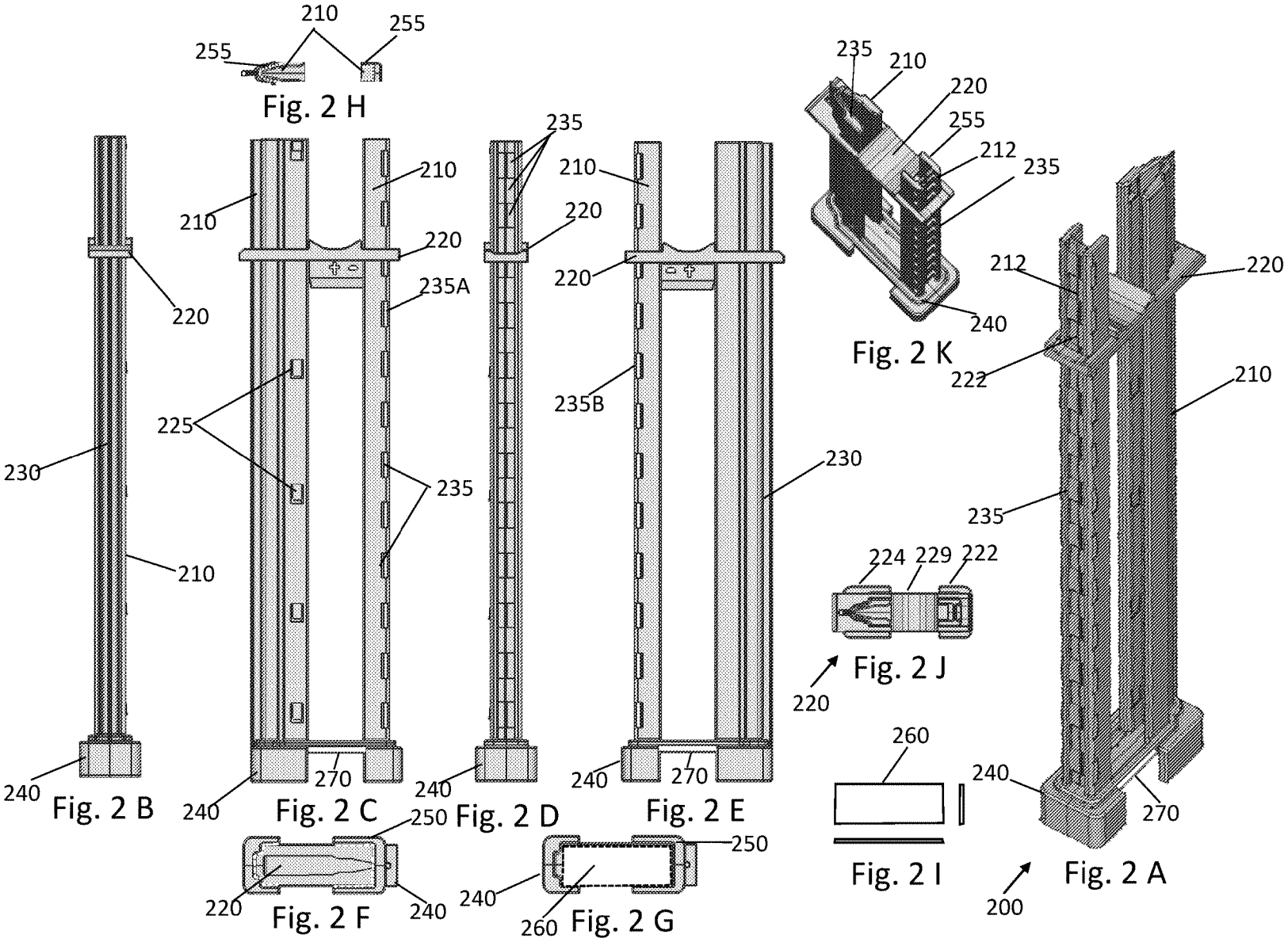

FIGS. 2 A through 2 K are sketches of an ammunition packaging and loading device 200 called a Pack & Load with components and features noted. Demonstrated in these sketches are: a Pack & Load ammunition packaging and loading device 200 holding thirty ammunition rounds 120; a set of rails 210 that hold the ammunition rounds 120 and act as tracks for the rounds 120 to slide through; a channel 212 configured to slidingly retain pusher 220 sliding end configuration 222; a pusher 220 is the mechanism that pushes the ammunition rounds 120 into the magazine 70; a set of teeth (tooth) 225 keeps the pusher 220 from going back up the rails 210 and holds the rounds 120 if a partial fill is used; a living hinge 230 which is on the bullet or lead side rail 210, will allow the packaging 200 to open, it is described as a living hinge which means that it is flexible enough to be opened and closed; a set of snaps 235 are male snaps 235A and female snaps 235B running like a zipper all the way up and down the rail 210 that is opposite of the hinge 230; a cup 240 is the base that goes around the magazine 70; an aperture 245 in cup 240 to receive and inter connect with interference fit to magazine 70; a set of bottom brushes 250 hold the rounds 120 in place after the removable tab 260 is peeled away; a set of top brushes 255 to hold the spent brass from rounds 120 in place after the Pack and lock 120 is emptied and inverted; a removable tab 260 is a small strip of plastic or equal that holds all the rounds 120 in place during transport and will then be placed into the slot; and a slot 270 is the opening for the removable tab 260 to go into if there is a partial load to hold leftover rounds 120 in the Pack and Load packaging 200.

Additional information as to the components and features include: Rails 210. They hold the rounds and act as tracks for the rounds to slide through. The rails are 2 C channels that have three sides. The rounds will slide down the rails to the cup before passing through the cup and into the magazine. The purpose of the rails is to hold the rounds in place during shipping and to align them with the cup so they can be pressed into the magazine. Next, the Pusher 220. It pushes the rounds into the magazine. The pusher is the sliding mechanism that becomes a cap as it passes down over the teeth. The teeth hold the pusher from being able to return back up, keeping constant pressure on the rounds and preventing them from sloshing around. The pusher also drives down the rounds, driving through the cup and into the magazine. The pusher has a molded shape on the bottom of it that is similar in shape and size of the brass on the rounds. There are three places for the fingers of the user to grip onto it. One in the middle that has a saddle shape and one on each end that has a soft rounded edge. The purpose of the pusher is to hold the rounds in place as a cap that locks below each tooth. It also is used in a downward force to drive the ammunition into the magazine. Then the Teeth or Tooth 225. It keeps the pusher from going back up to hold the rounds if a partial fill is used. The teeth extends out from the body of one of the rails. It has molded gaps between itself and the rail. The gaps are below and on the right and left sides of each tooth. The pusher will press the tooth down and into the rail allowing the pusher to pass by the tooth. Once the pusher has passed by the tooth, the tooth will spring back out, blocking the pusher from being able to return back up the rail. The purpose is to lock or block the pusher from sliding back up toward the top of the rail; holding the pusher and the rounds in place. And then the living hinge 230 which is on the bullet or lead side rail, will allow the packaging to open or closed. The hinge is described as a living hinge. Meaning that it is flexible enough to be opened and closed. The purpose of the hinge is to allow a clam shell design of the packaging to be opened up so the rounds can be placed into the packaging making for a simple opening and closing. The hinge will also have male and female snaps to prevent it from expanding as the rounds are under pressure from the pusher. Next is the snaps 235 which are male and female snaps running like a zipper all the way up and down the rail that is opposite of the hinge. The purpose of the snaps are to lock the clam shell design of the packaging. Securing the packaging in a permanent closed position. Moving then to the Cup 240. It is the base that goes around the magazine. The cup is an opening at the bottom of the packaging. The cup is the same dimension as the receiver on the AR rifle, allowing all magazine manufacturers to be able to be used in this packaging. The top side of the cup has a hole that is shaped as a round but is approximately a few one-hundreths of an inch larger than the rounds. This keeps the rounds lined up for the magazine. The purpose of the cup is to engulf the top of the magazine giving it a formed snug fit over the magazine. This will keep the packaging in alignment with the magazine ensuring the rounds are lined up with the opening in the magazine. And the Bottom Brushes 250 that hold the rounds in place after the removable tab is peeled away. With pressure, the rounds pass by them into the magazine. The bottom brushes are on the inside of the cup in the hole that is shaped like the rounds. They are small pieces of plastic that stick out of the hole in the cup that is shaped like a round. They are similar to strands of plastic filament in a brush of a toothbrush. The purpose of the bottom brushes is to temporarily hold the rounds in place after the removable tab is taken away. The brushes will expand out and flex down as pressure is placed upon the rounds to allow the rounds to go into the magazine. Next the Top Brush 255. They hold the brass from rounds in place after the Pack & lock is emptied and inverted. With pressure, the brass pass by them into the open space between the rails. The top brushes are on the inside of the cup in the hole that is shaped like the rounds. They are small pieces of plastic that stick out of the hole in the cup that is shaped like a round. They also are similar to strands of plastic filament in a brush of a toothbrush. Moving to the Removable tab 260. This holds all the rounds in place in transport. It will go into the slot. The removable tab is perforated on each side. It is located at the bottom of the opening right below the brushes. The purpose is to hold the ammunition securely during shipping. The removable tab which will have a lip similar to a pop can tab, will be pulled out by the pressure on the lip of the tab. The tab will tear along the perforated edges. The removable tab can be placed back inside of the slots in the cups to once again create a secure stop to stabilize the rounds so the packaging can be transported with rounds that would remain after a partial fill. Finally, the slot 270. It is the opening for the removable tab to go into if there is a partial load to hold leftover rounds in the packaging. The slots are a slit hole of about an inch in length. The slots are completely open on both sides of the cup. The purpose of the slot is to allow the removable tab to be inserted through both slots securing the rounds from coming down onto the brushes. Making a secure plate to hold the rounds from falling through the brushes while the packaging is being moved after a partial fill.

Figures 3A, 3B, 3C, 3D, 3E, 3F, 3G, 3H, 3I:
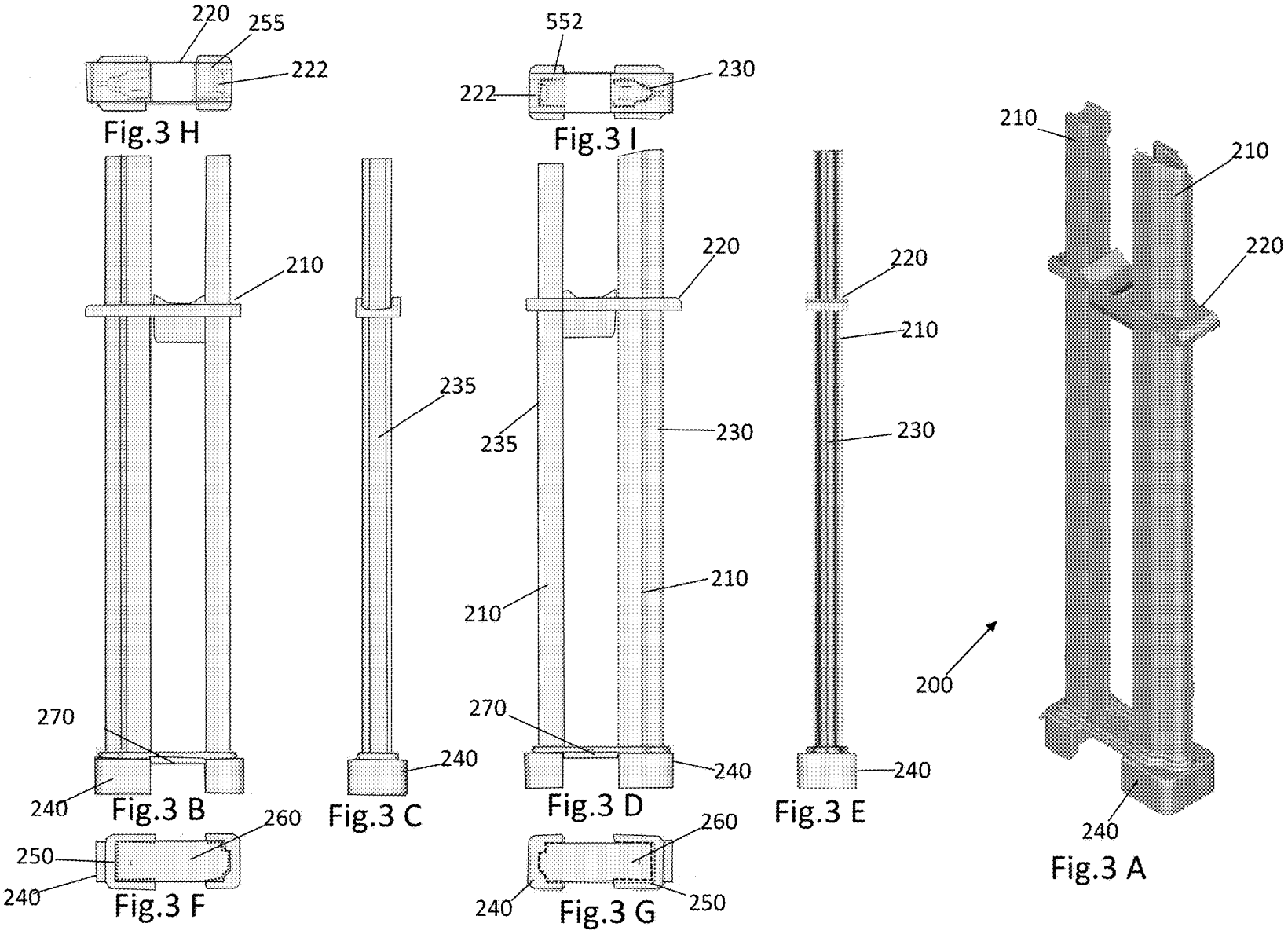

FIGS. 3 A through 3 I are more sketches of an ammunition packaging and loading device 200 called a Pack & Load with components and features noted. Again are other views portraying components and their features. Shown are: a Pack & Load ammunition packaging and loading device 200 holding thirty ammunition rounds 120; a set of rails 210 that hold the ammunition rounds 120 and act as tracks for the rounds 120 to slide through; a channel 212 configured to sliding retain pusher 220 sliding end configuration 222; a pusher 220 is the mechanism that pushes the ammunition rounds 120 into the magazine 70; a set of teeth (tooth) 225 keeps the pusher 220 from going back up the rails 210 and holds the rounds 120 if a partial fill is used; a living hinge 230 which is on the bullet or lead side rail 210, will allow the packaging 200 to open, it is described as a living hinge which means that it is flexible enough to be opened and closed; a set of snaps 235 are male snaps 235A and female snaps 235B running like a zipper all the way up and down the rail 210 that is opposite of the hinge 230; a cup 240 is the base that goes around the magazine 70; an aperture 245 in cup 240 to receive and inter connect with interference fit to magazine 70; a set of bottom brushes 250 hold the rounds 120 in place after the removable tab 260 is peeled away; a set of top brushes 255 to hold the spent brass from rounds 120 in place after the Pack & lock 120 is emptied and inverted; a removable tab 260 is a small strip of plastic or equal that holds all the rounds 120 in place during transport and will then be placed into the slot; and a slot 270 is the opening for the removable tab 260 to go into if there is a partial load to hold leftover rounds 120 in the Pack & Load packaging 200.

Figures 4A, 4B, 4C, 4D:
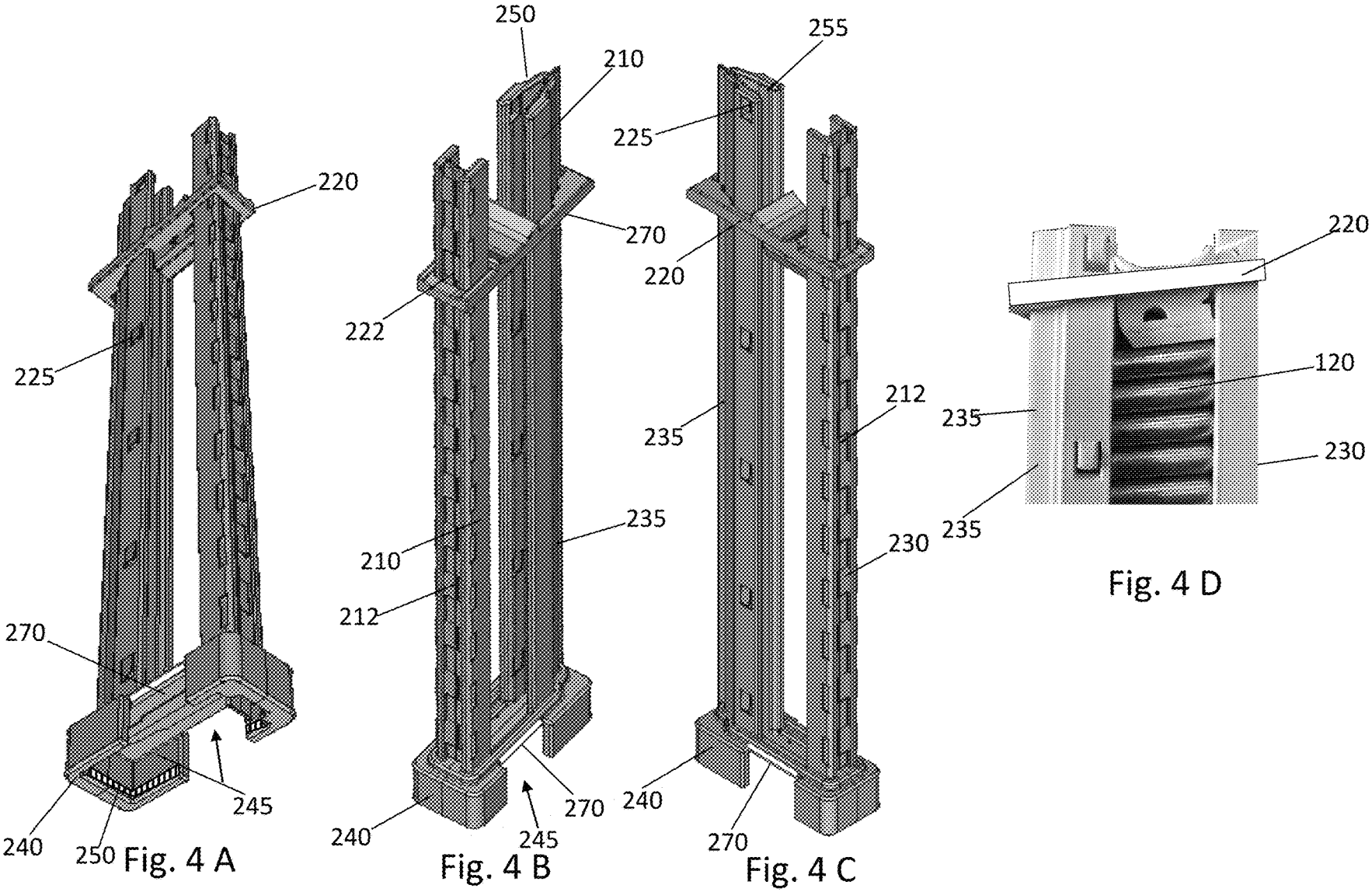

FIGS. 4 A through 4 D are isometric sketches of an ammunition packaging and loading device 200 called a Pack & Load from an isometric with components and features noted. Provided in these sketches are a Pack & Load ammunition packaging and loading device 200 holding thirty ammunition rounds 120; a set of rails 210 that hold the ammunition rounds 120 and act as tracks for the rounds 120 to slide through; a channel 212 configured to slidingly retain pusher 220 sliding end configuration 222; a pusher 220 is the mechanism that pushes the ammunition rounds 120 into the magazine 70; a set of teeth (tooth) 225 keeps the pusher 220 from going back up the rails 210 and holds the rounds 120 if a partial fill is used; a set of snaps 235 are male snaps 235A and female snaps 235B running like a zipper all the way up and down the rail 210 that is opposite of the hinge 230; a cup 240 is the base that goes around the magazine 70; an aperture 245 in cup 240 to receive and inter connect with interference fit to magazine 70; a set of bottom brushes 250 hold the rounds 120 in place after the removable tab 260 is peeled away; a set of top brushes 255 to hold the spent brass from rounds 120 in place after the Pack & lock 120 is emptied and inverted; and a slot 270 is the opening for the removable tab 260 to go into if there is a partial load to hold leftover rounds 120 in the Pack & Load packaging 200.

Figures 5A, 5B, 5C, 5D, 5E, 5F, 5G:
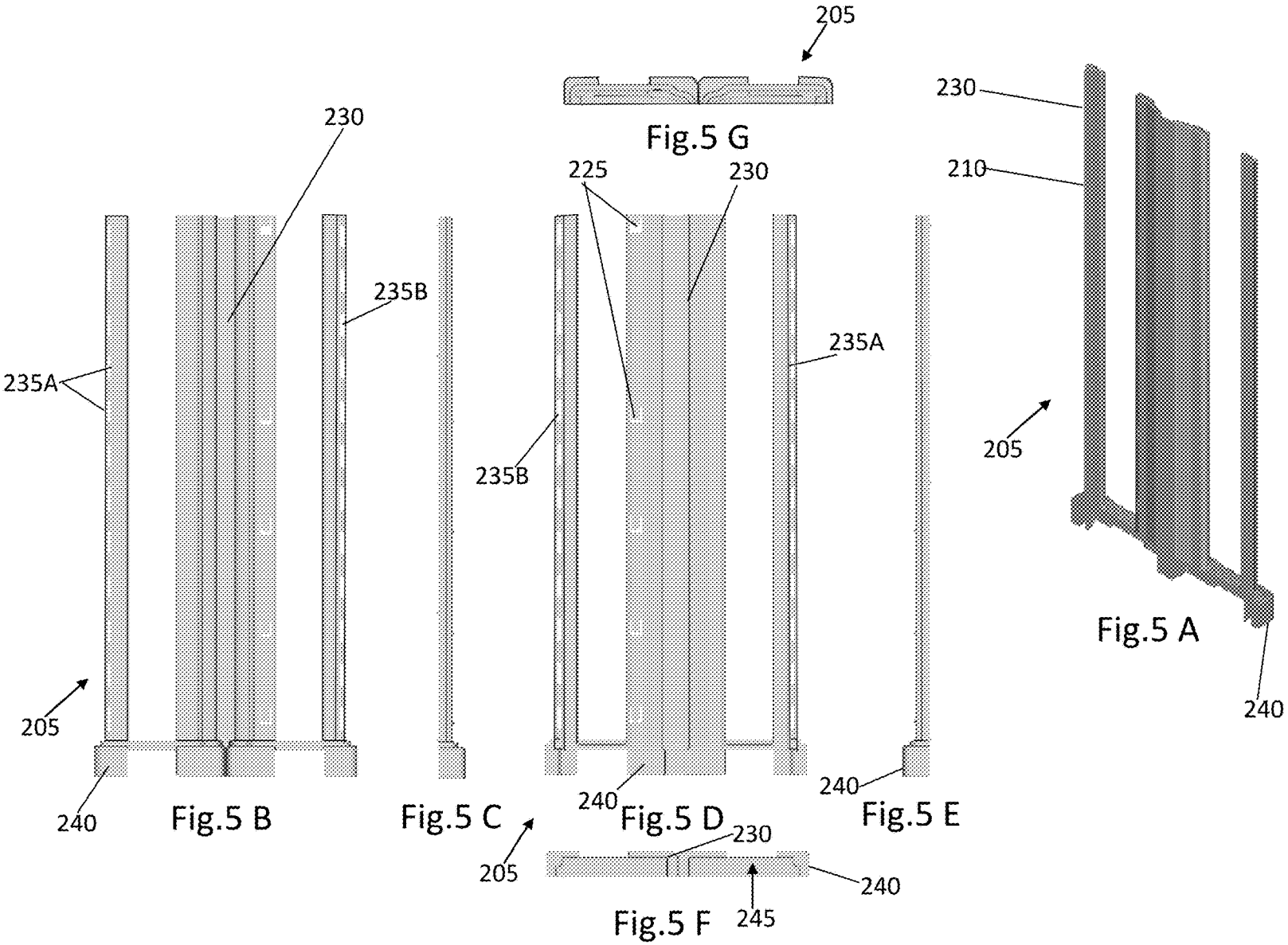

FIGS. 5 A through 5 G are sketches of the two part clamshell 205 of an ammunition packaging and loading device 220 called a Pack & Load with components and features noted. Shown are: a Pack & Load ammunition packaging and loading device 200 holding thirty ammunition rounds 120; an open clamshell 205 of the Pack & Load ammunition packaging and loading device 200 with a living hinge 230 joining two sides of rails 210; a set of teeth (tooth) 225 keeps the pusher 220 from going back up the rails 210 and holds the rounds 120 if a partial fill is used; a living hinge 230 which is on the bullet or lead side rail 210, will allow the packaging 200 to open—it is described as a living hinge which means that it is flexible enough to be opened and closed; a set of snaps 235 are male snaps 235A and female snaps 235B running like a zipper all the way up and down the rail 210 that is opposite of the hinge 230; and a cup 240 is the base that goes around the magazine 70.

Figures 6A, 6B, 6C, 6D, 6E, 6F, 6G, 6H, 6I, 6J:
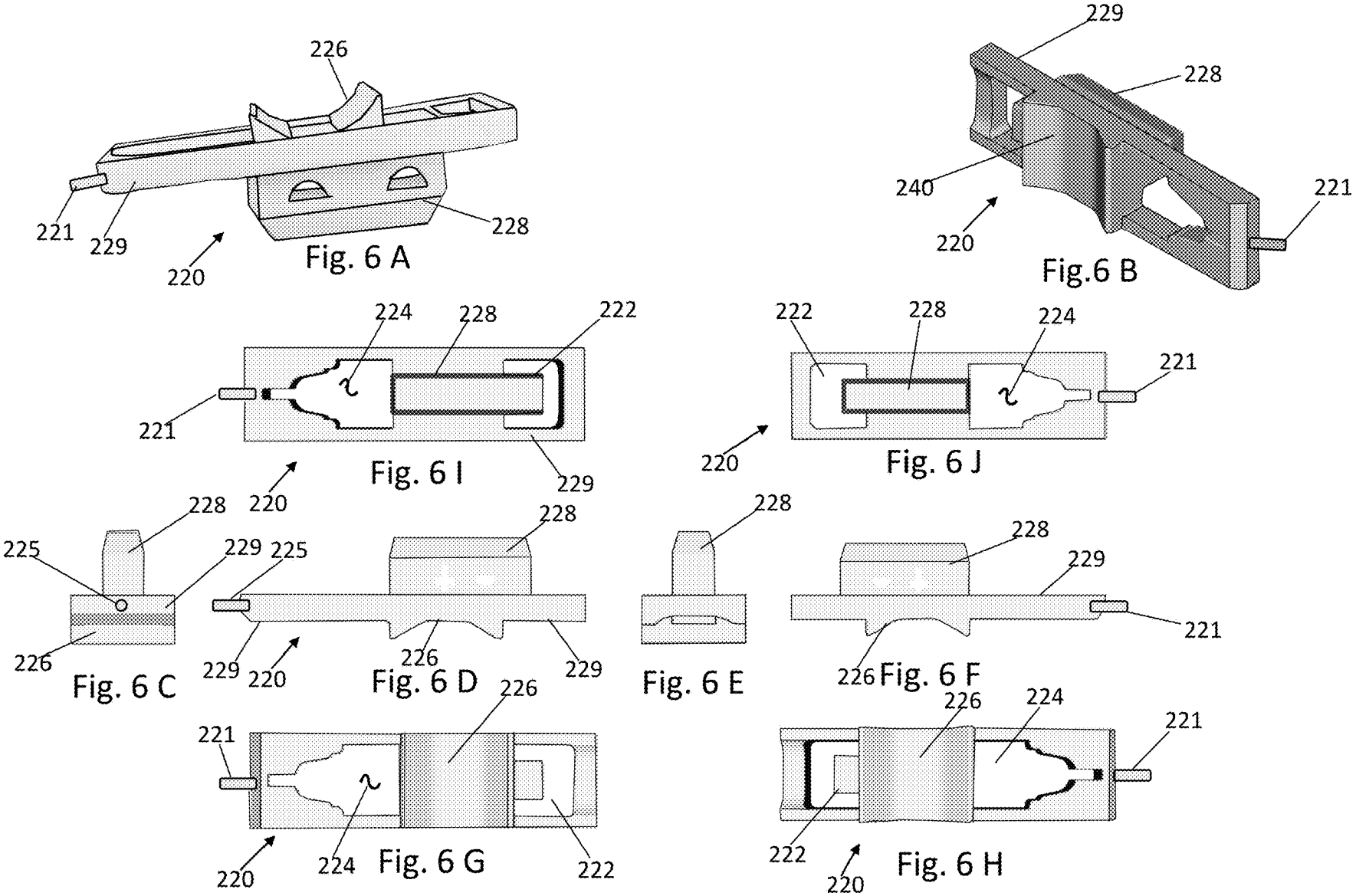

FIGS. 6 A through 6 J are sketches of pusher 220 component of the ammunition packaging and loading device 200 called a Pack & Load with components and features noted. Specific details shown here are: a pusher 220 is the mechanism that pushes the ammunition rounds 120 into the magazine 70; a small pin 221 on the pusher 220 used to press out the pins on the AR rifle for field stripping; a sliding end configuration 222 to engage channel 212 of rails 210; an open aperture configuration 224 to contain snapped end of rails 210; a saddle 226 for thumb to push and move pusher 220; a strengthening rib 228 of pusher 220; and a flat member 229 of pusher 220. The small pin 221 will be manufactured onto the pusher. This pin 221 will be used to press out the pins on the AR rifle for field stripping. Many of the shooters use a bullet for this job. Now this will be a safer and easier way to do this job.

Figures 7A, 7B, 7C, 7D, 7E, 7F, 7G:
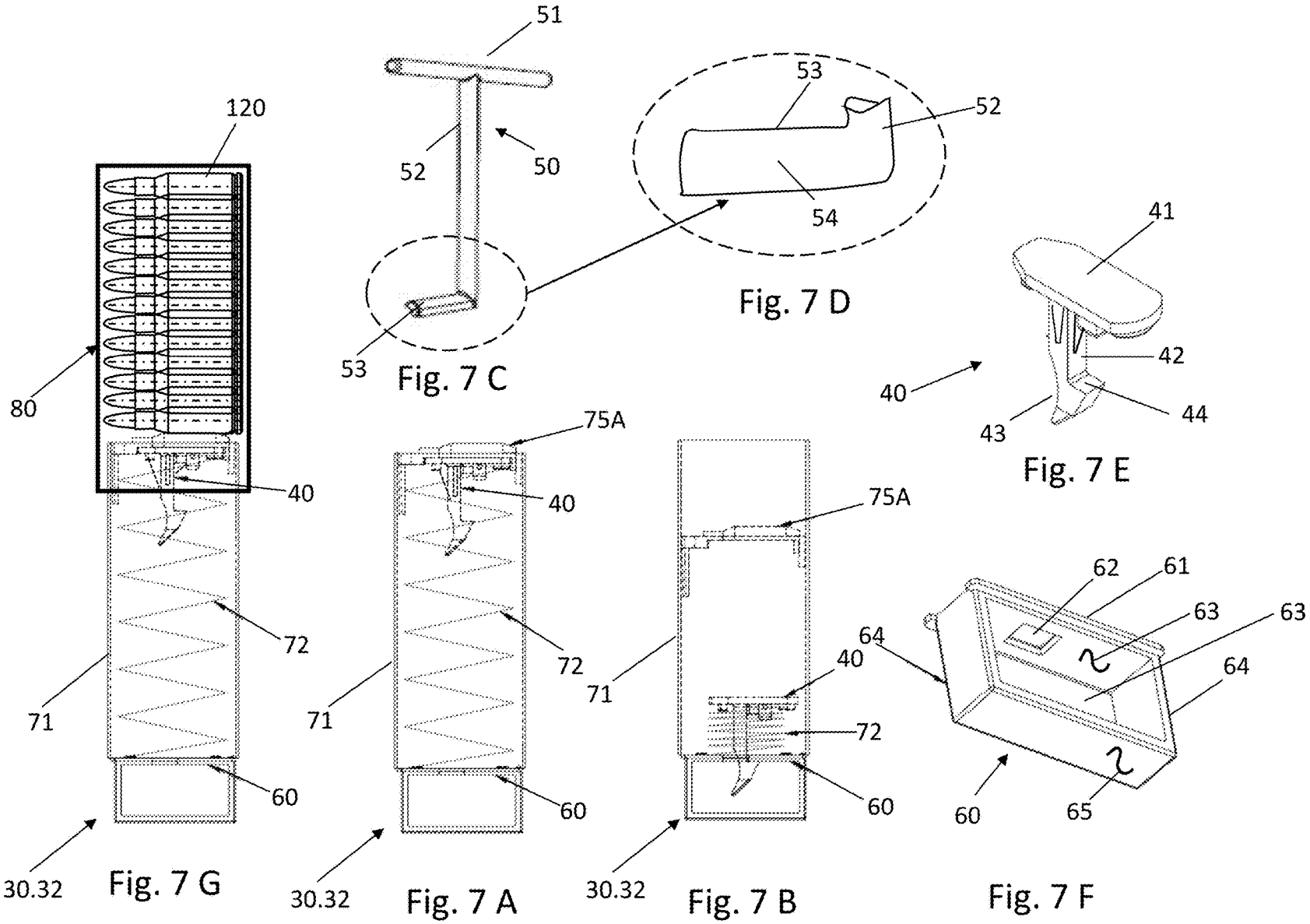

FIGS. 7 A through 7 G are sketches of a prototype Internal locking/latching magazine device and coupling ammunition container called a "Lock and Load" 30 with components and features noted. Demonstrated in these views are: an Internal locking/latching magazine device and coupling ammunition container called a "Lock and Load" 30; drawings 32 of Internal locking/latching magazine device and coupling ammunition container called a "Lock and Load" 30; trigger component 40 of the Internal locking/latching magazine device and coupling ammunition container called a "Lock and Load" 30; top plate 41 of the trigger component 40; trigger post 42 of the trigger component 40; contour 43 for finger of the trigger component 40 to release ammunition and latch on the device 30; flat 44 for latching of the trigger component 40 to the base plate 63 on the device 30; a push rod component 50 of the improved magazine loader device 30; rod handle 51; rod post 52; post extender 53 at 90 degrees/perpendicular to rod post 52; round contour 54 to match with contour of ammunition round 120; baseplate and trigger guard box 60; slide configuration 61 to slide ably interconnect guard box 60 with magazine case 71; aperture opening 62 in guard box 60 for trigger 44; base plate 63 baseplate and trigger guard box 60; parallel sides 64 of baseplate and trigger guard box 60; bottom 65 of baseplate and trigger guard box 60; interior space 66 of baseplate and trigger guard box 60; exterior case 71 of traditional magazine 70; spring 72 of traditional magazine 70; and a follower 75A (without stop post 76) of new device 30. Note that the free-floating follower 76A is special. The free-floating follower 76A has the middle post 76 cut out. The trigger 40 is attached to the spring 72. Next, the base plate 63 is at the bottom of the spring 72 which is what the trigger post 42 goes through in the aperture 62. That base plate 63 is the top part of the base plate and trigger guard 60. The trigger 40 latch is now attached to the spring 72 through the aperture 46. The advantage of the free floating follower 76A is that it can be used to pick up the ammunition 120 without touching it and it allows the trigger 40 latch to use the spring 72 to force the trigger 40 to latch with the flat 44 and the base plate 63 at the aperture 62.

Figures 8A, 8B, 8C, 8D:
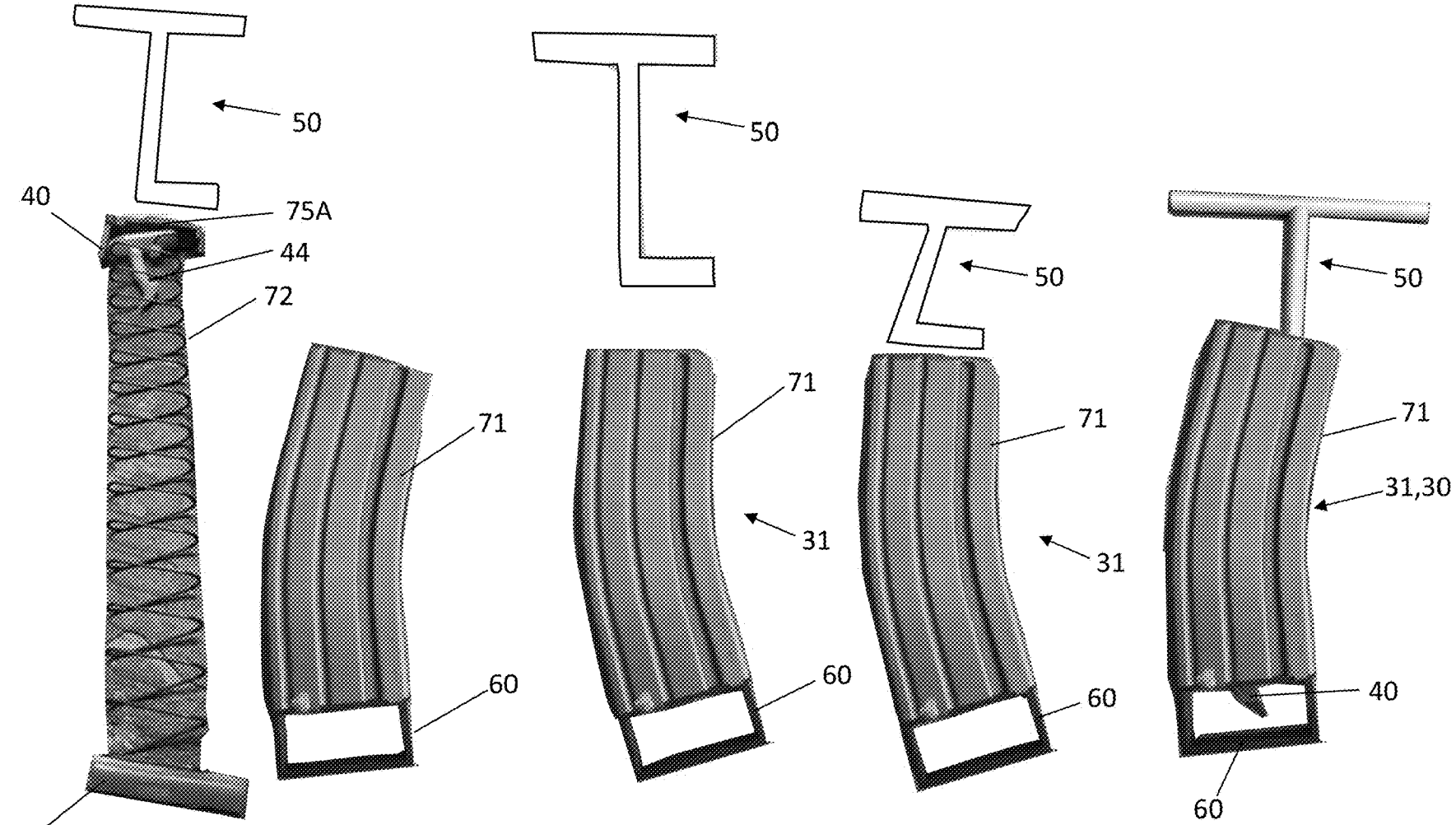

FIGS. 8 A through 8 D are sketches of a prototype Load and Lock 31 with the components and features shown from front view. Viewed here one sees: Internal locking/latching magazine device and coupling ammunition container called a "Lock and Load" 30; prototype sample 31 of Internal locking/latching magazine device and coupling ammunition container called a "Lock and Load" 30; trigger component 40 of the Internal locking/latching magazine device and coupling ammunition container called a "Lock and Load" 30; a flat 44 for latching of the trigger component 40 to the base plate 63 on the device 30; a push rod component 50 of the improved magazine loader device 30; a baseplate and trigger guard box 60; base plate 63 feature of the baseplate and trigger guard box 60; an exterior case 71 of traditional magazine 70; a spring 72 of traditional magazine 70; and a follower 75A (without stop post 76) of new device 30.

Figures 9A, 9B, 9C, 9D, 10A, 10B, 10C:
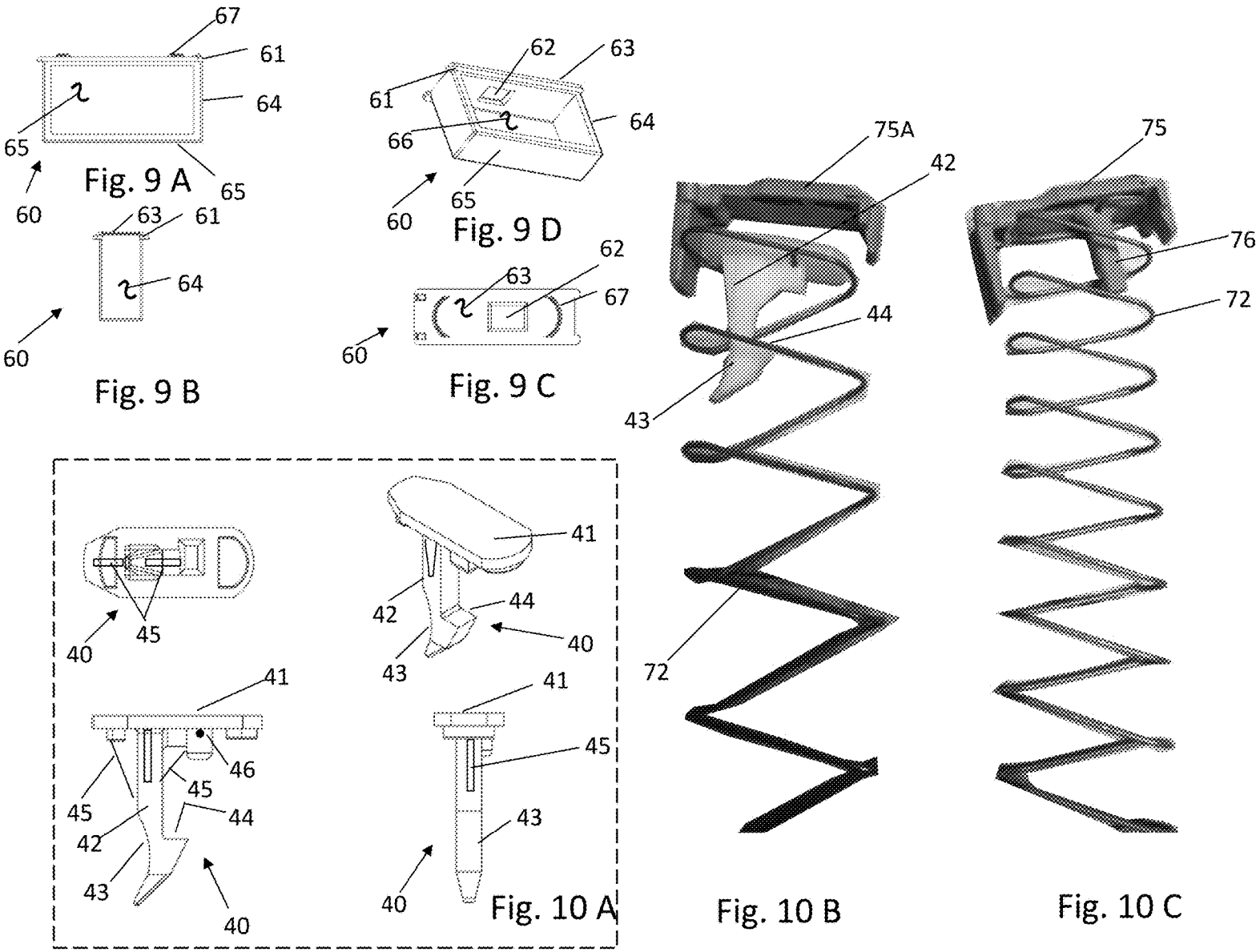
Figure 11E:
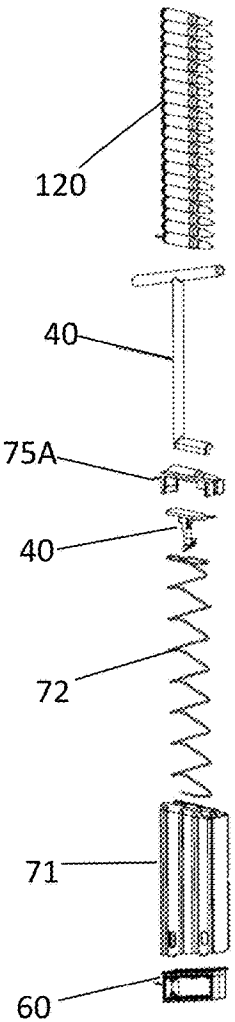
Figure 11D:
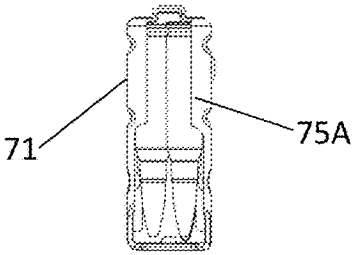
Figure 11C:
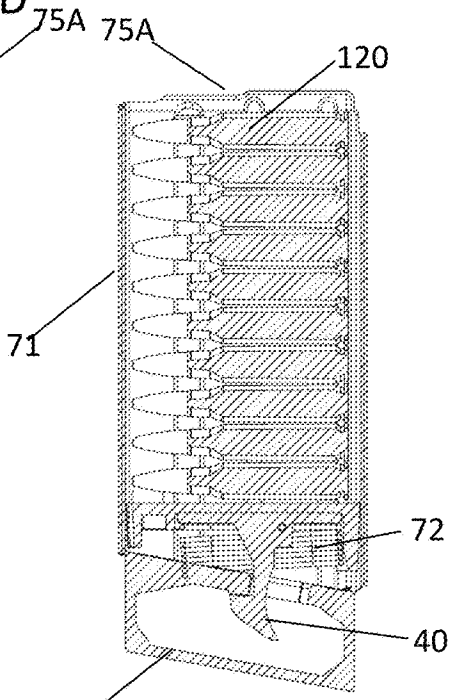
Figure 11B:
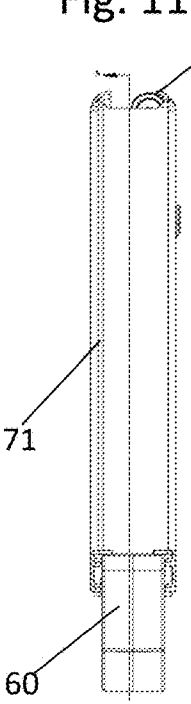
Figure 11A:
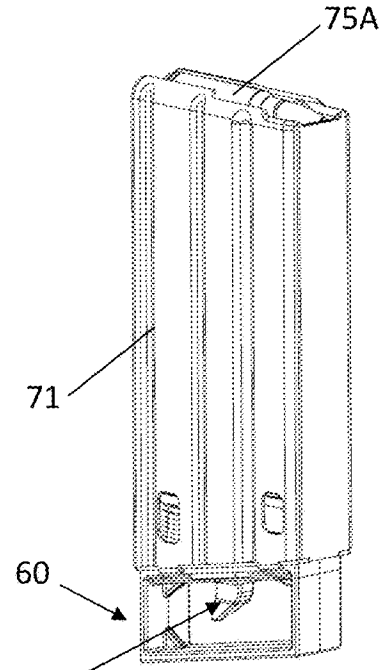

FIGS. 9 A through 9 D are sketches of the base plate and trigger protection component 60 with features shown from several views. Shown in this group of drawings are: a baseplate and trigger guard box 60; slide configuration 61 to slide ably interconnect guard box 60 with magazine case 71; aperture opening 62 in guard box 60 for trigger 44; base plate 63 baseplate and trigger guard box 60; parallel sides 64 of baseplate and trigger guard box 60; bottom 65 of baseplate and trigger guard box 60; interior space 66 of baseplate and trigger guard box 60; and a spring ear 67 of baseplate and trigger guard box 60.

FIGS. 10 A through 10 C are sketches of the trigger component with features indicated and a trigger prototype 40 shown. Demonstrated are: a trigger component 40 of the Internal locking/latching magazine device and coupling ammunition container called a "Lock and Load" 30; a top plate 41 of the trigger component 40; a trigger post 42 of the trigger component 40; a contour 43 for finger of the trigger component 40 to release ammunition and latch on the device 30; a flat 44 for latching of the trigger component 40 to the base plate 63 on the device 30; gussets 45 of the trigger component 40; an aperture 46 for end of spring 72 in the trigger component 40; a spring 72 of traditional magazine 70; a follower 75 of traditional magazine 70; a follower 75A (without stop post 76) of new device 30; and a stop post 76 of follower 75, FIGS. 11 A through 11 E are sketches of the components and assembly comprising the internal locking/latching magazine device and coupling ammunition container called a "Lock and Load" 30. Portrayed here are: an internal locking/latching magazine device and coupling ammunition container called a "Lock and Load" 30; drawings 32 of internal locking/latching magazine device and coupling ammunition container called a "Lock and Load" 30; trigger component 40 of the Internal locking/latching magazine device and coupling ammunition container called a "Lock and Load" 30; a baseplate and trigger guard box 60; a traditional magazine 70; an exterior case 71 of traditional magazine 70; a spring 72 of traditional magazine 70; and a follower 75A (without stop post 76) of new device 30. Also, FIG. 6 E shows a cross section of the internal latch "Lock and Load" 30 with all the components denoted.

Figures 12A, 12B:
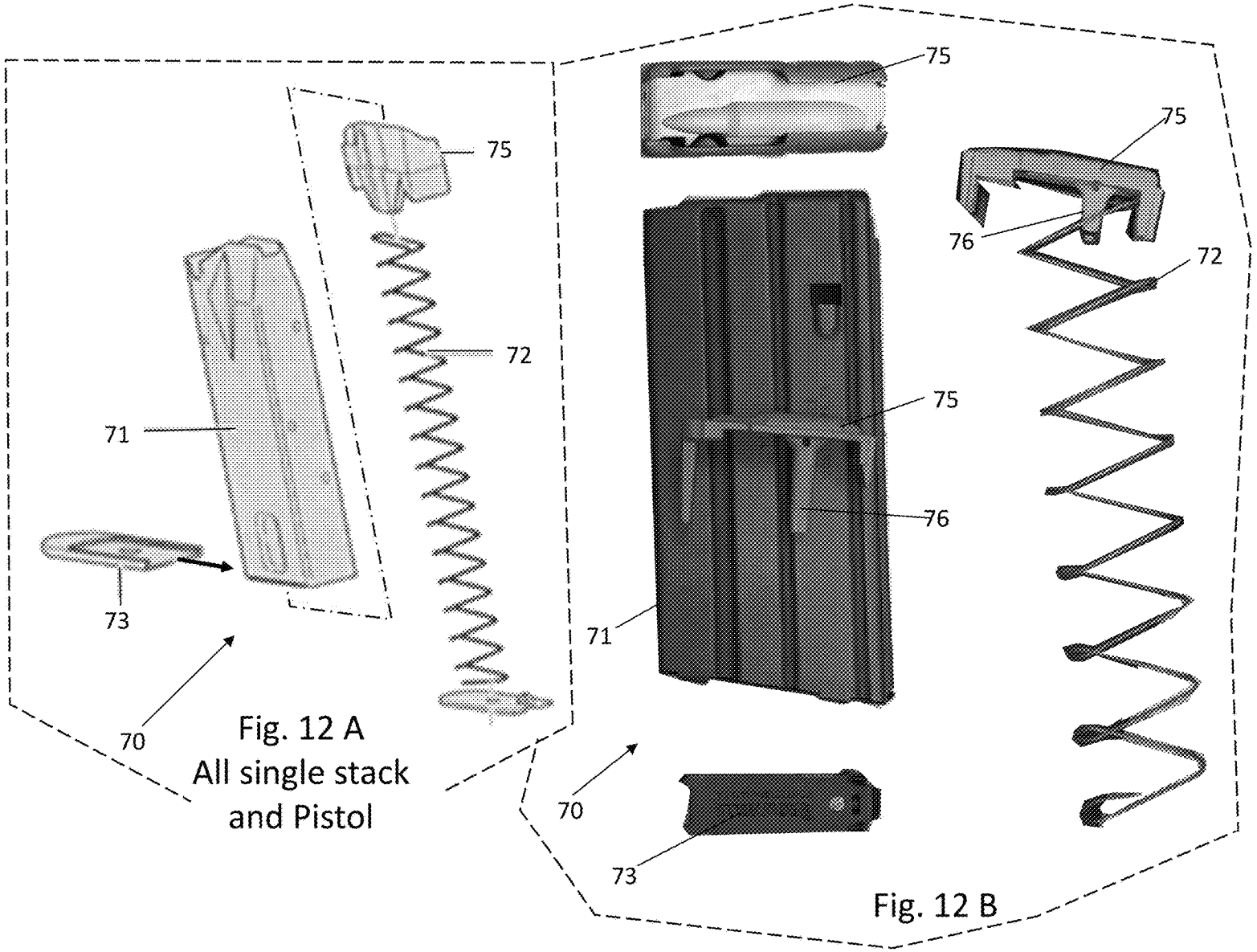

FIGS. 12 A and 12 B are sketches and a prototype 31 of a typical ammunition magazine with features and components shown from a generally front view. Provided are: a traditional magazine 70; an exterior case 71 of traditional magazine 70; the spring 72 of traditional magazine 70; a base plate 73 of a traditional magazine 70; a follower 75 of traditional magazine 70; and a stop post 76 of follower 75.

Figures 13A, 13B, 13C, 13D, 13E:
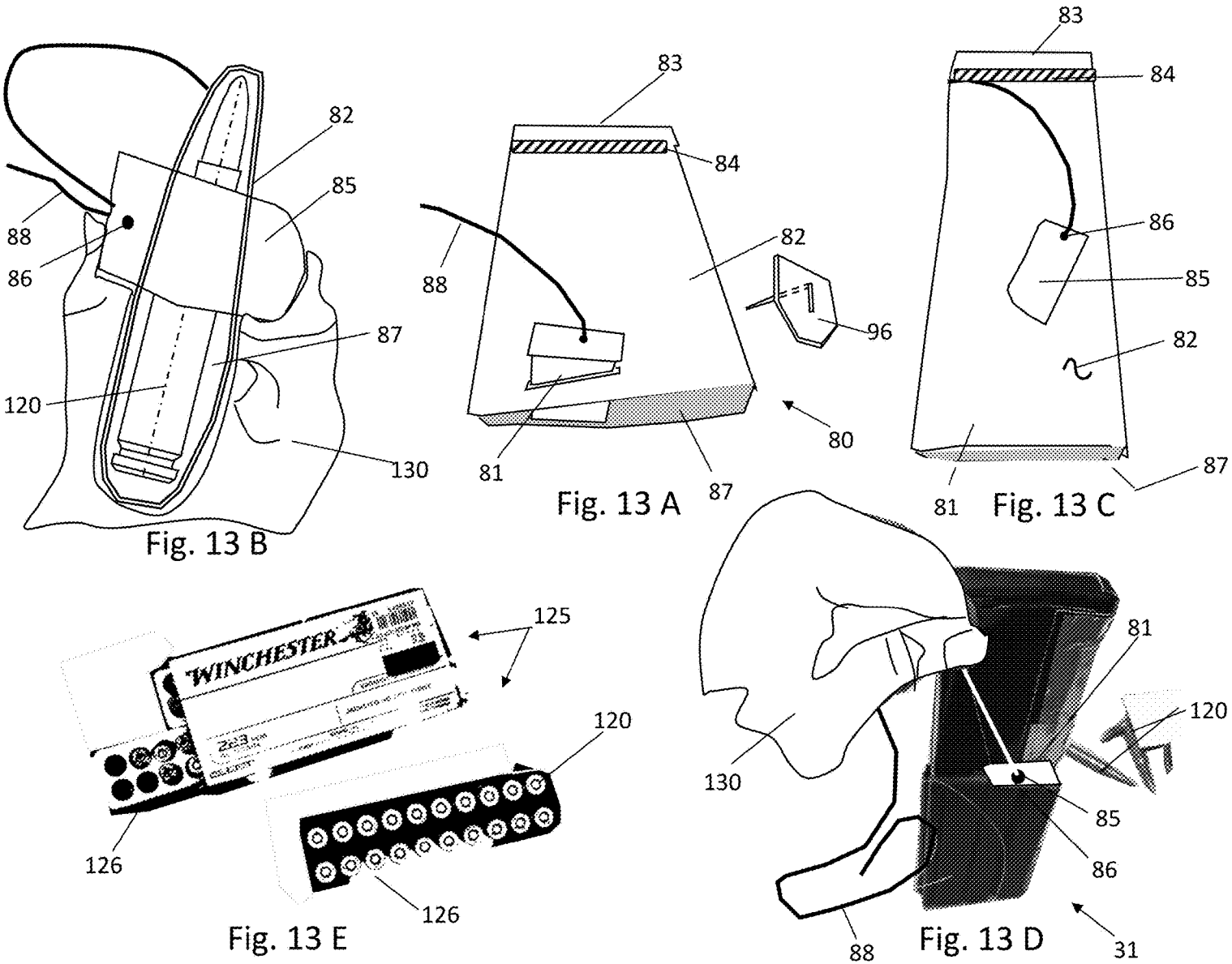

FIGS. 13 A through 13 E are sketches that portray a contoured ammunition package and a prototype 31 of the improved magazine 30 coupled together. One views from these drawings: a prototype sample 31 of Internal locking/latching magazine device and coupling ammunition container called a "Lock and Load" 30; a contoured to ammunition package 80; an aperture/slot 81 for stop wing/tab 85; the packaging sidewalls 82 of contoured to ammunition package 80; a crimped end 83 of contoured to ammunition package 80; a means 84 for securing crimped end 83 and the two sidewalls 82 to create an open ended envelop or sleeve contoured to ammunition rounds 120; a stop wing/tab 85; an aperture 86 in stop wing/tab 85 for securing a filament/fiber/wire/string/or equal 88; an open contour 87 contiguous to rounds 120; a securing filament/fiber/wire/string/or equal 88; a quick release 96 tab; ammunition rounds 120; a typical box/container 125 for ammunition rounds 120; and a rounds holder 126 such as Styrofoam with recessed holes/pocket for each round 120.

Figure 14C:
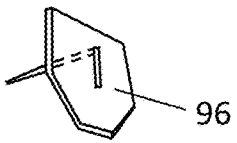
Figure 14A:
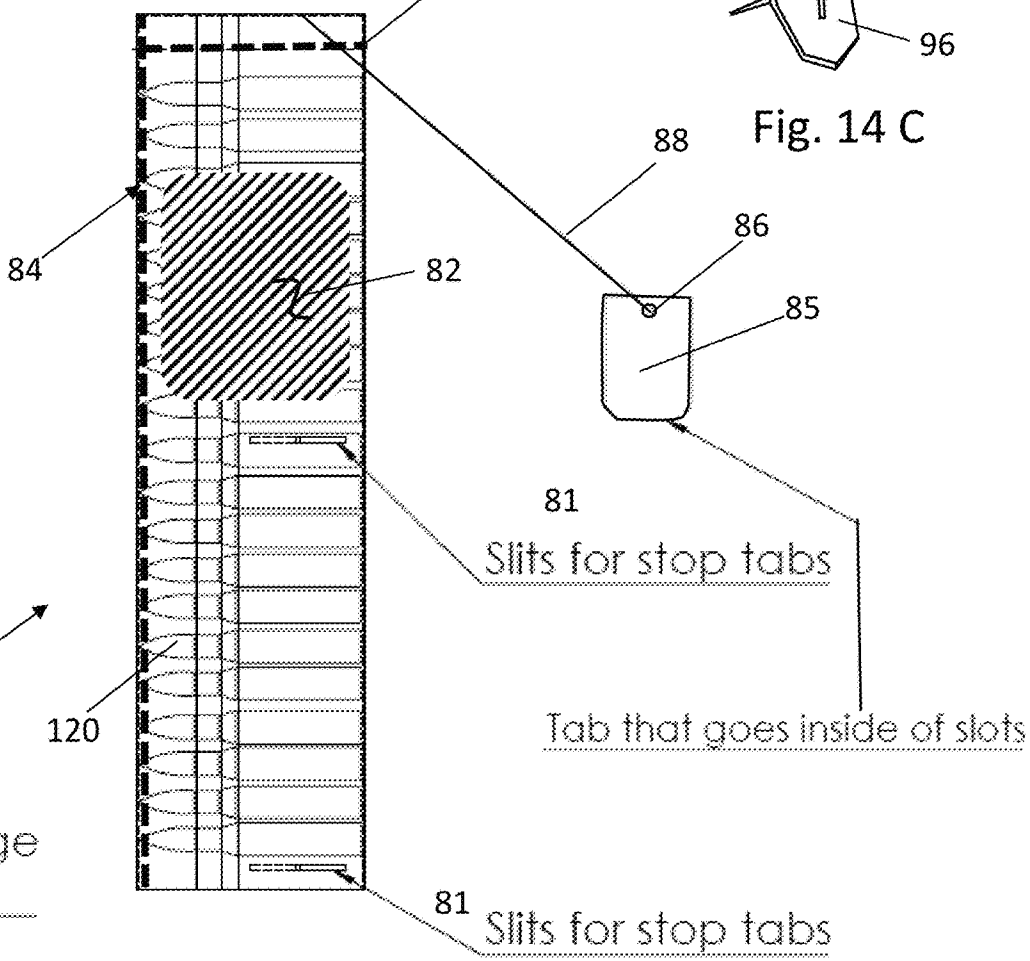
Figure 14B:
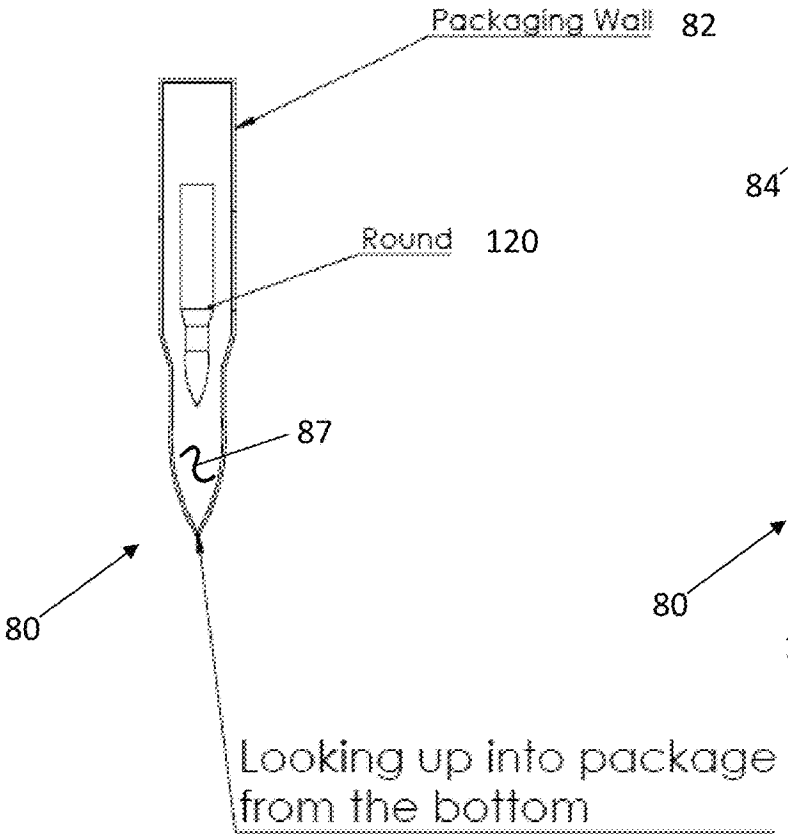

FIGS. 14 A through 14 C are more sketches of the contoured ammunition package 80. Here are details as follows: the contoured to ammunition package 80; an aperture/slot 81 for stop wing/tab 85; packaging sidewalls 82 of contoured to ammunition package 80; a crimped end 83 of contoured to ammunition package 80; a means 84 for securing crimped end 83 and two sidewalls 82 to create an open ended envelop or sleeve contoured to ammunition rounds 120; a stop wing/tab 85; an aperture 86 in stop wing/tab 85 for securing filament/fiber/wire/string/or equal 88; an open contour 87 contiguous to rounds 120; a securing filament/fiber/wire/string/or equal 88; and the ammunition rounds 120. One may note that there are two views of the packaging. The FIG. 9 B is looking down the throat of the package seeing where the ammunition rounds are located. The FIG. 9 A is a side view showing the rounds stopped by where the tab 85 that would go into the bottom slot 86 and hold the rounds 120 above the slot 86. The second tab slot 86 one sees would be a stop for extra rounds 120 that would be in the packaging. The packaging will include a built in rod 50 to lock the Magazine. FIG. 9 C shows the optional quick release 96 tab. This has a tab with a pin which will disengage or automatically pull the quick release 96 out as the pusher mechanism or the contoured package 80 passes and pops the pin so the tab is flipped out of the slot or slit 81 and the ammunition 120 is freed to drop into the magazine 70.

FIGS. 15 A and 15 B are sketches of a single round loading ammunition package 90 to be coupled with the Internal locking/latching magazine device called a "Lock and Load" 30. These drawings show: an ammunition loading package 90 for single round 120 loading into Internal locking/latching magazine device and coupling ammunition container called a "Lock and Load" 30; a round holding and guiding configuration/ledges 91; a package surface 92; the pocket 95 for single rounds 120; and the ammunition rounds 120.

FIGS. 16 A and 16 B are sketches of both a single stack 100 and double stack 110 ammunition package to be coupled with the Internal locking/latching magazine device called a "Lock and Load" 30. This type works for all pistols and single stack magazines. Displayed here are the following components and features: an ammunition loading package 100 for double stacked rounds 120; a plethora of collapsible flaps 101; a closed end 102; a pair of closed sides 103; an openable end 104; an ammunition loading package 110 for single stacked rounds 120; a plethora of collapsible flaps 111; a closed end 112; a pair of closed sides 113; an openable end 114; and several ammunition rounds 120. Packaging 100 is for the double stack magazine. It goes inside of the magazine. The packaging 110 for the single stack goes on the outside of the magazine. The side flaps 101, 111 can be a Styrofoam or cardboard insert that will collapse as the magazine presses down in releasing each round. Also design the packaging 100, 110 allows it to split open as the magazine presses in releasing the ammo 120. The point of the flaps 101, 111 is that the rounds 120 are being held by the packaging so they will stay in place until the magazine opens or collapses it to release the ammo 120.

Figure 17B:
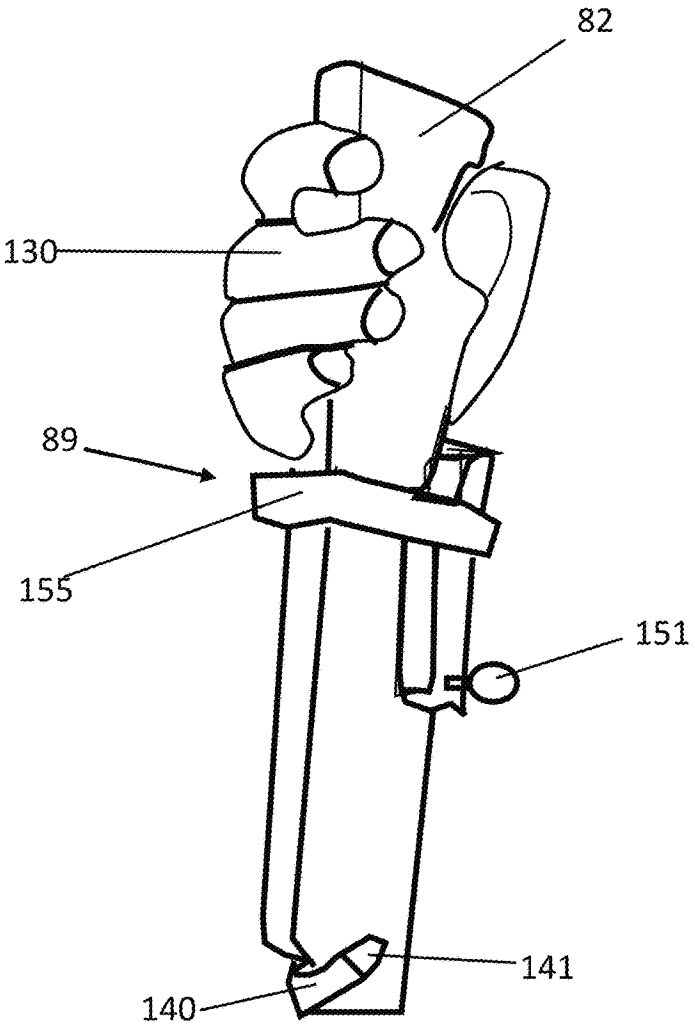
Figure 17A:
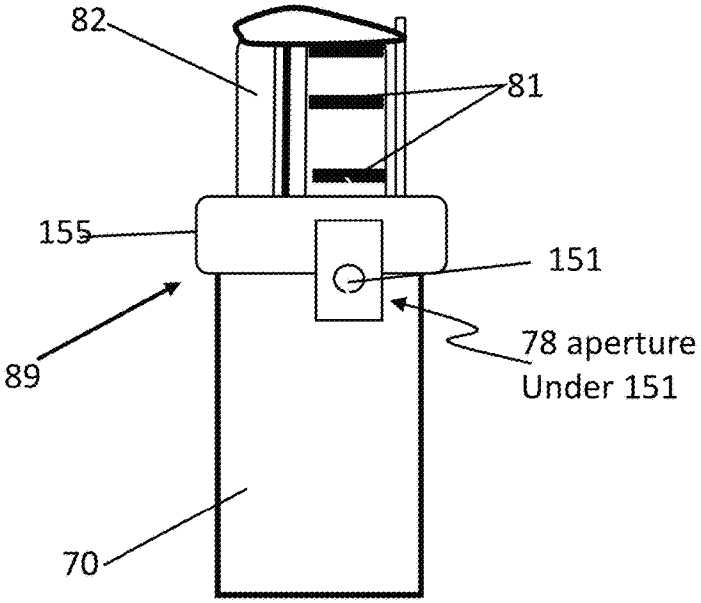
Figure 18A:
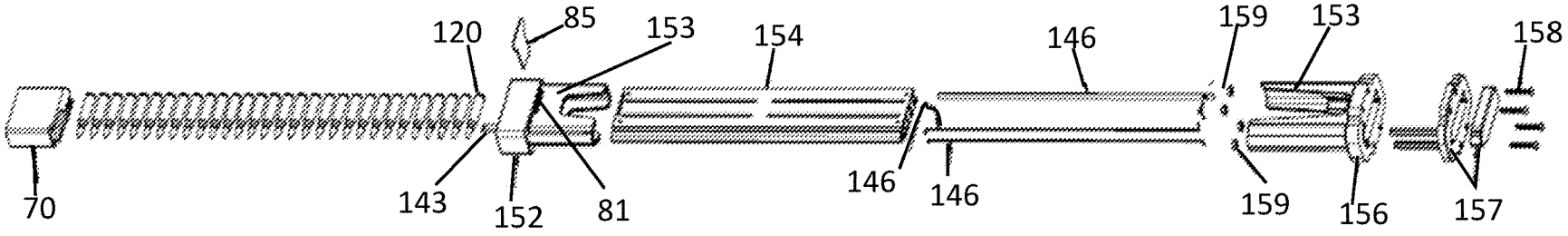
Figure 18B:
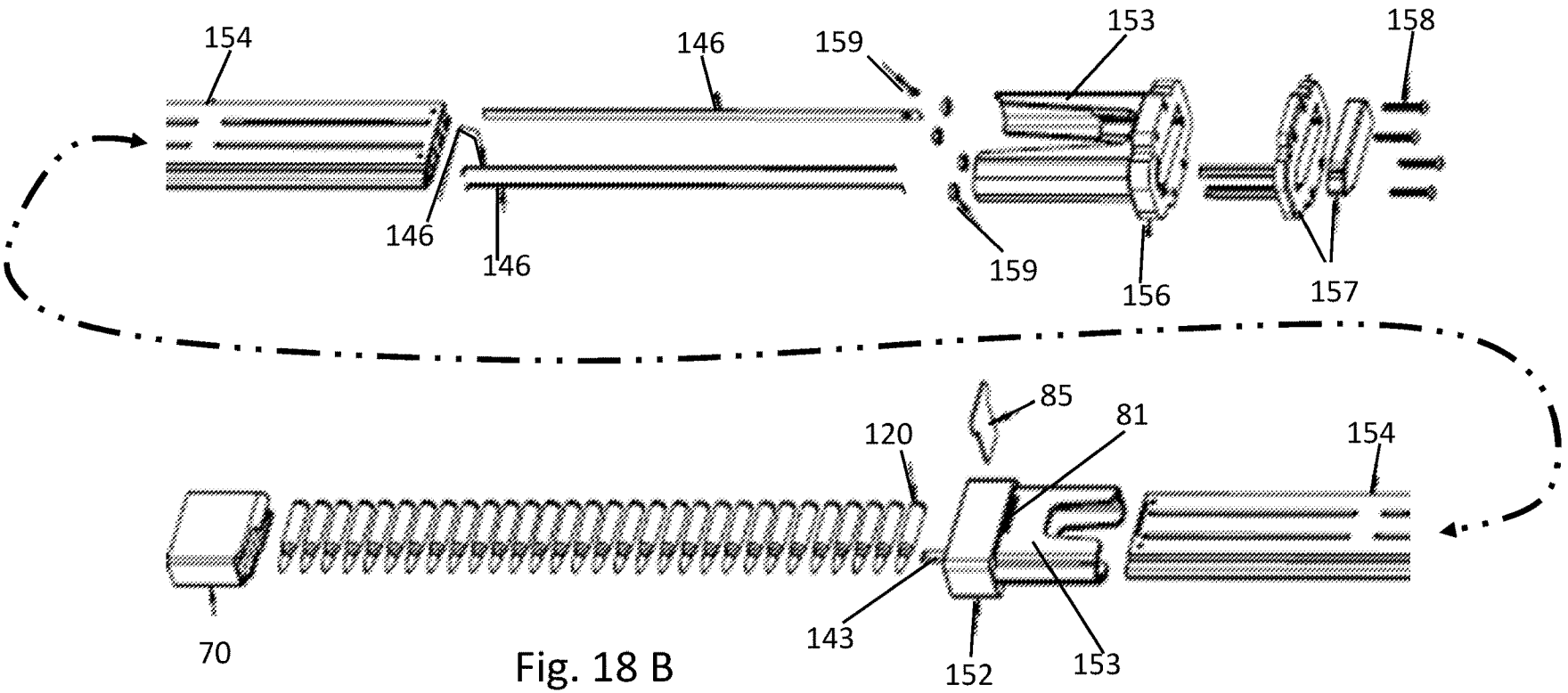
Figure 18F:
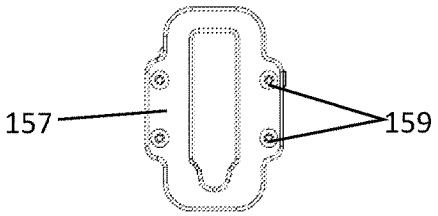
Figure 18E:
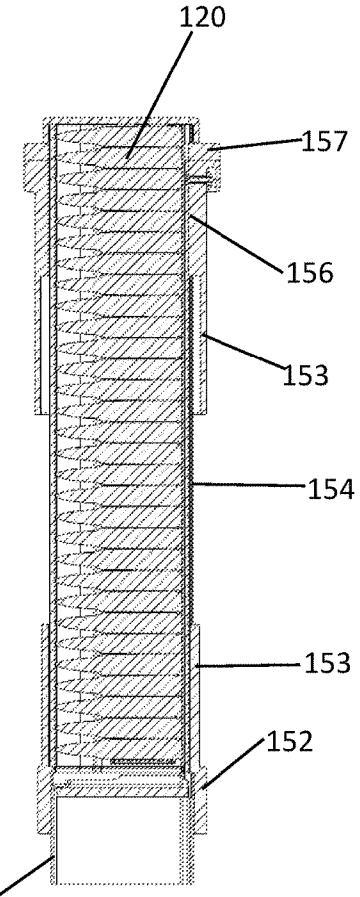
Figure 18D:
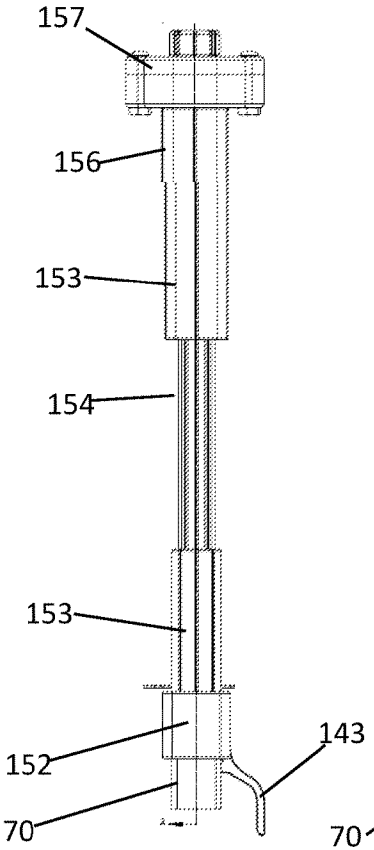
Figure 18C:
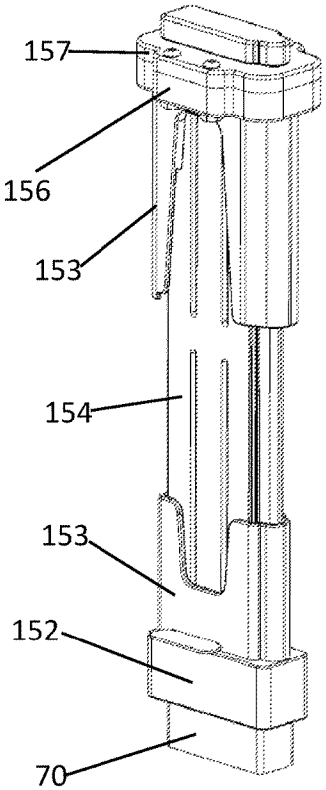
Figure 18H:
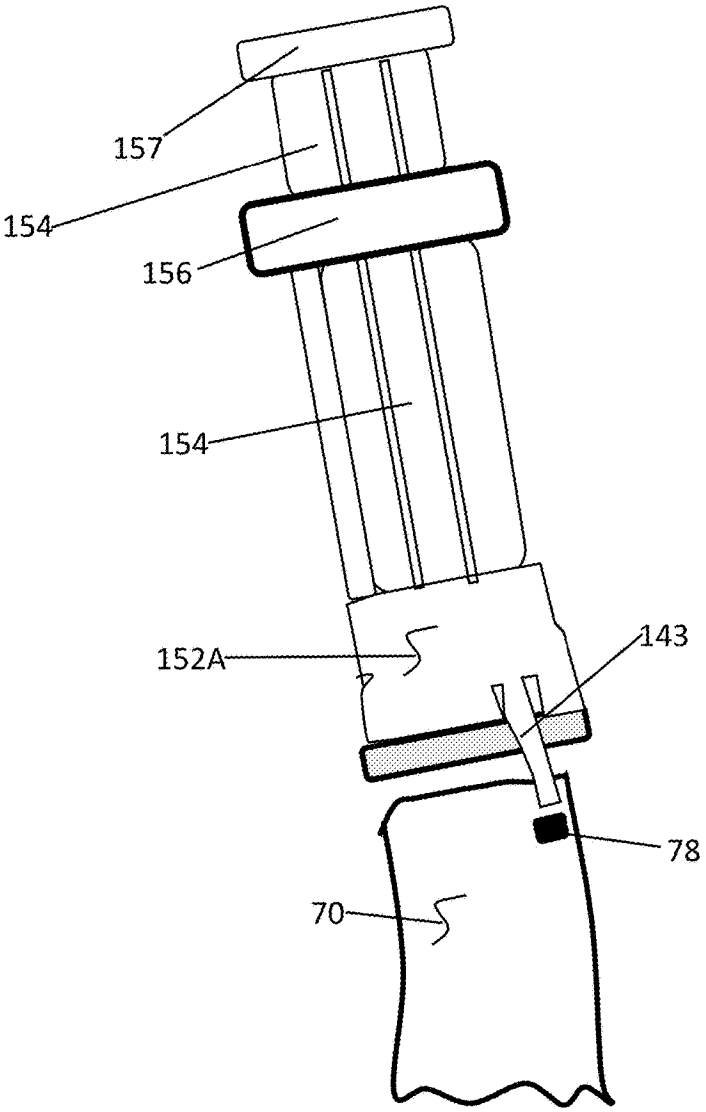
Figure 18G:
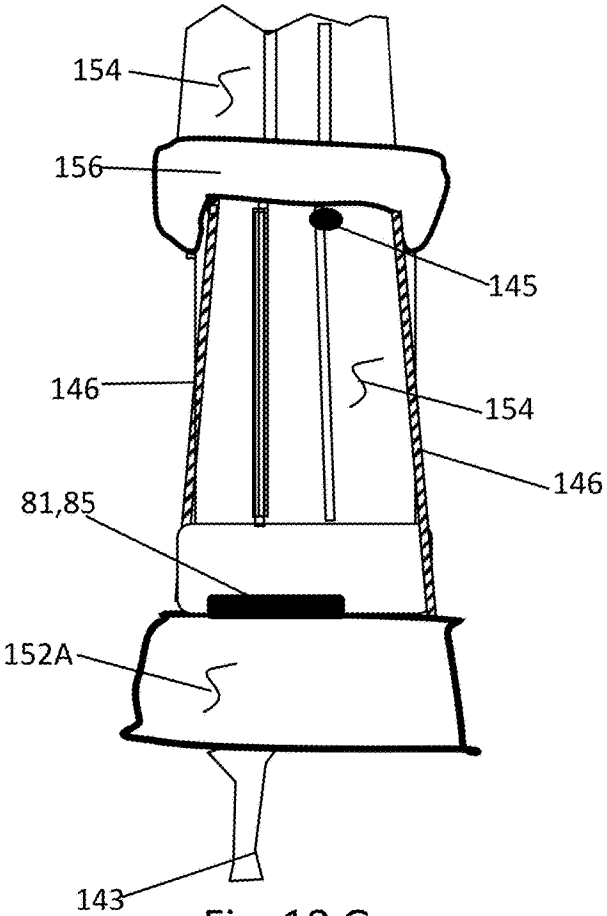

FIGS. 17 A and 17 B are sketches of the collar or cuff external locking/latching magazine device 89 and coupling ammunition container 80. Shown here are the following components and features: an external latching cuff/collar 89 to accept packaging 80 and then, in combination with packaging 80, push down and load ammunition rounds 120 directly into magazine 70 or sleeves; an external latch 140 for cuff/collar device 89—may be metal, steel, spring steel, plastic, composite material easy to form with spring properties; an end keeper angle 141 of external latch 140; an outside screw 150 presses tightly against walls 82 to adjust the opening size 87 needed to hold the package 80 and the magazine 70 square to each other and keep openings in each 70, 80 (87) in line for the ammunition rounds 120 to pass easily; an outside follower button 151 of collar 89, the button 151 engages the aperture 78 of the magazine 70 during loading; a universal aperture 78 at load end/top of magazine 70 for receiving external latch mechanisms is not visible; an essentially rectangular structure 155 of external latch collar 89 holding pressure button 150 and latch 151; a magazine 70; a slot for the hold tab 85, and the exterior surface 82 of the contoured ammunition package 80.

FIGS. 18 A through 18 H are sketches and drawings of the prototypes for the external locking/latching sleeve device 144, 144A and coupling ammunition container 80. Provided and demonstrated in these sketches are: a universal aperture 78 at load end/top of magazine 70 for receiving external latch mechanisms latch tab 143; an external latch tab 143 that engages universal aperture 78 on magazine 70; an external locking/latching sleeve device 144 and coupling ammunition container called a "Lock and Load" 144 with extended support legs 153; an external locking/latching sleeve device 144A and coupling ammunition container called a "Lock and Load" 144 without extension support; an internal, horizontal cross rod 145 of external latching sleeve devices 144, 144A to maintain pressure on the ammunition rounds 120 at a slight angle; an external rod 146 of external latching sleeve devices 144, 144A (at least one or up to three vertical rods aligning magazine 70 with sleeve 144, 144A during push down on ammunition rounds 120); a load base 152 with external leg/extensions 153 features of external locking/latching sleeve device 144; a load base 152A of external locking/latching sleeve device 144A with no extensions; an external leg/extensions 153 feature to hold rods 146, 145; a housing 154 portion between load base 152, 152A and sleeve cap and plate 157; a push plate 156 with external leg/extensions 153 features; a push plate 156A with no extensions; a sleeve cap and plate 157; one or more fasteners 158 for sleeve cap 157; one or more fasteners 159 for rods 146, 145; a magazine 70; a slot for the hold tab 85, and the exterior surface 82 of the contoured ammunition package 80.

There are various materials are anticipated for the devices 200, 30, 89, 144, 144A as well as the ammunition packages 80. Durable materials are anticipated for the devices 30, 89, 144, 144A, 200 which include steel, steel alloys, aluminum, brass, plastic, poly urethane, reinforced plastic, and composite materials. Disposable materials for the contoured ammunition package 80 anticipated are, but are not limited to, thin, non-reinforced plastic, compressed cardboard, compressed fiber boards, and biodegradable composite materials.

Figure 19:
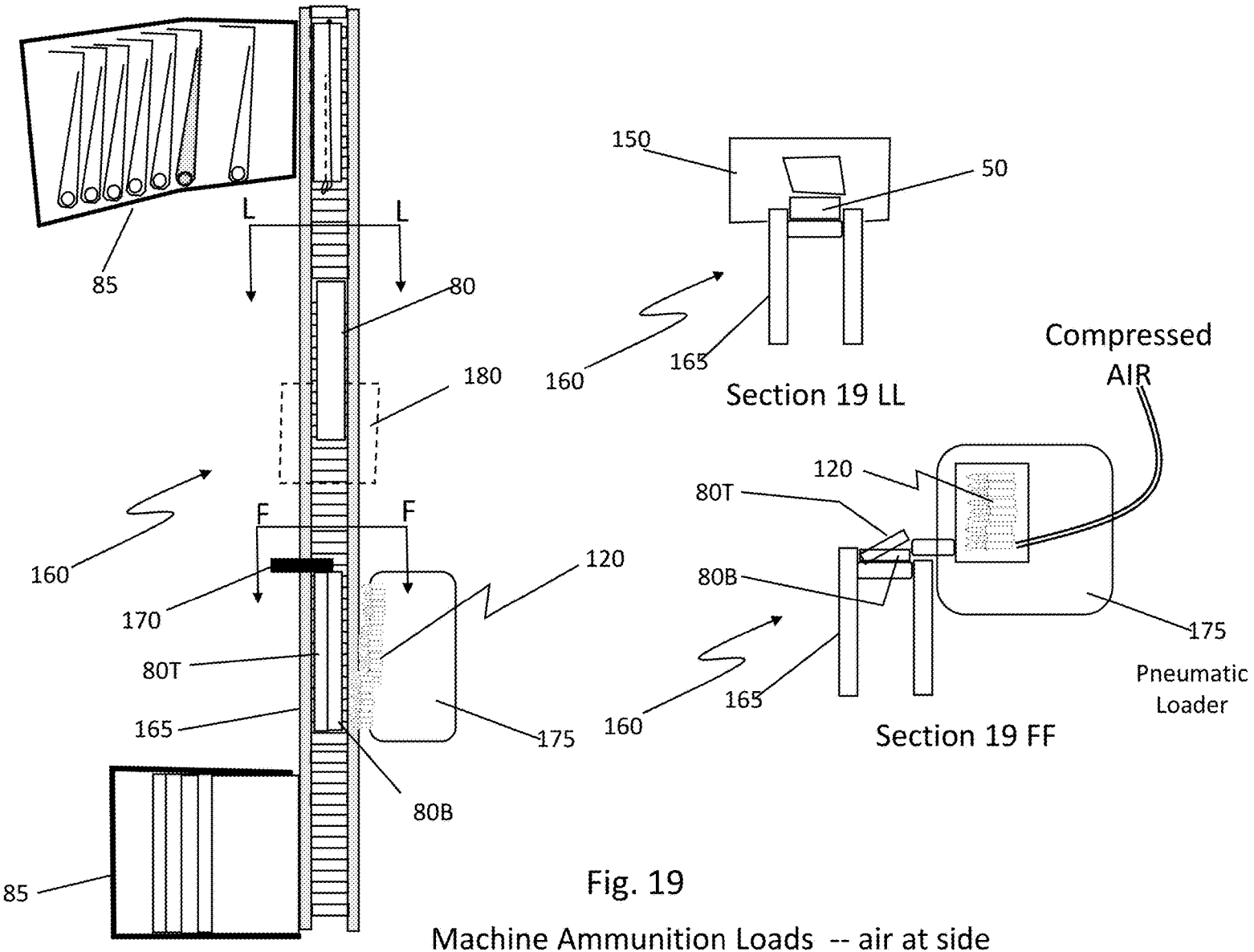

FIGS. 19, 19 LL, and 19 FF are sketches of an ammunition loading machine 160 with the external and internal locking/latching magazine devices 30, 144, 144A and coupling ammunition container. Shown here are: an ammunition package filling machine 160; a sheet loader station 185; a powered and timed roller conveyor 165; a box stop 170; the ammunition pneumatic air pressured round loader 175; a top 80T closer and securing the top 80T to bottom 80B mechanism at station 180 of the machine 160; a contoured to ammunition package 80; a top 80T of contoured to ammunition package 80; a bottom 80B of contoured to ammunition package 80, and the ammunition rounds 120. As the open container 80 with a top 80T and bottom 80B passes the pneumatic loader 175, the rounds 120 are forced into the box 80. Next the package 80 runs across the closing and sealing station 180 and the rounds 120 are secured in the package 80 and ready for pallet or container pack out or additional labeling. An additional station is anticipated after the top is fastened. Here the additional station or a secondary operation will permit the spring external latch 140 or trigger 40 and latch flat 44 to be incorporated with the packaging and be automated to attach to a magazine at an internal or external latch automatic unload station 190. An Assembly line type machine will bring an empty magazine under a rod that will depress the follower down. A sleeve that is attached to a hopper of the machine, will go into the magazine and drop ammo rounds in and pull out. Then the rod will be lifted out by the machine. The machine will then conveyed by a belt. With the full magazine out of the way an empty magazine will come under the machines rod and sleeve.

Figure 20A:
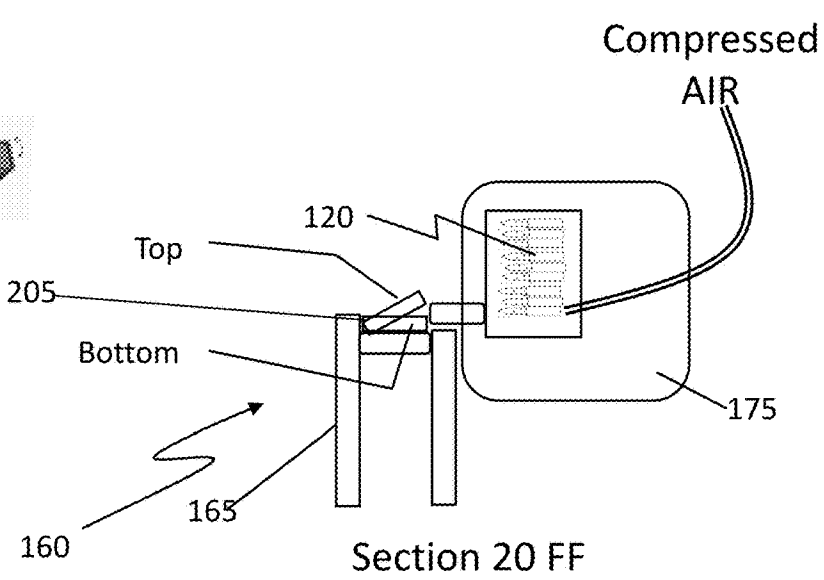
Figure 20A:
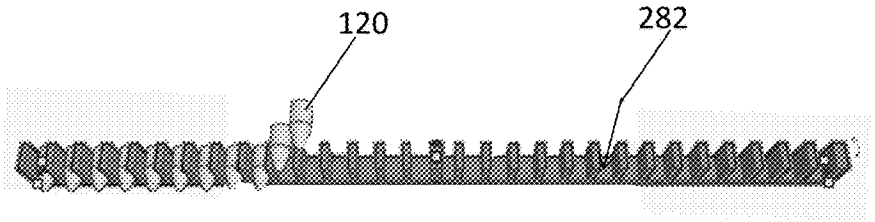
Figure 20B:
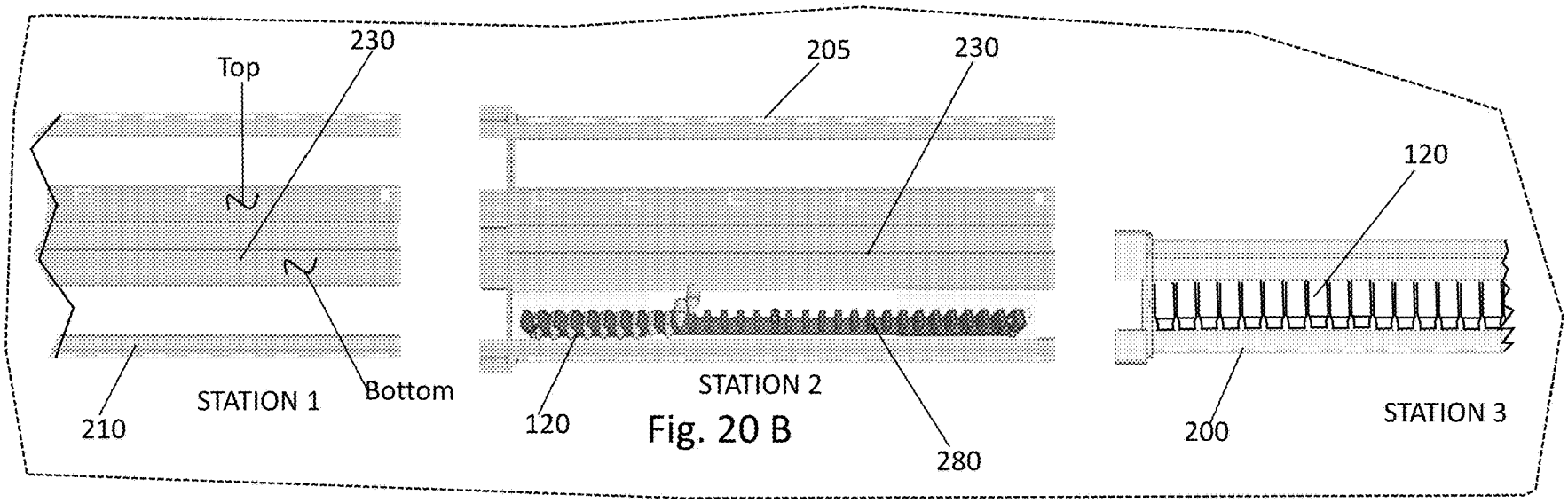

FIGS. 20 A, 20 B and 20 FF are sketches of the alignment guide 280 and manufacturing ease for assembly into the clam shell 205 Pack & Load device 200. Easy fulfillment of the butterfly design/clam shell 205 will make fulfillment at the factory an easy process. The supplied grid system 280 supplied to the factory will attach to the work station allowing the rounds 120 to be held in place until the butterfly packaging 205 is closed and grid removed. The grid system gives the packaging the capability to be fully automated with the pneumatic fill machine in existing packaging plants.

The details mentioned here are exemplary and not limiting. Other specific components and manners specific to describing an ammunition packaging and loading device called a Pack & Load 200 and an Internal locking/latching magazine device and coupling ammunition container called a "Lock and Load" 30, 89, 144, 144A may be added as a person having ordinary skill in the field of the art of ammunition magazine loaders and packaging devices and their uses well appreciates.

Operation of the Preferred Embodiment

The ammunition packaging and loading device called a Pack & Load 200; the Internal locking/latching magazine device and coupling ammunition container called a "Lock and Load" 30; and the external latch cuff/collar 89 and external sleeve devices 144, 144A have been described in the above embodiment. The manner of how these devices operate are described below. One notes well that the description above and the operation described here must be taken together to fully illustrate the concept of the ammunition packaging and loading device called a Pack & Load 200 and the Lock and Load 30, 89, 144, 144A.

The preferred embodiment of an ammunition packaging and loading device called a Pack & Load is an ammunition packaging and loading device (200) made of durable materials and called a Pack and Load is comprised of: (a). pair of mirror imaged side rails (210) each of the pair of side rails with a left and right side and a top pushing end and a bottom cup (240) end and each of the pair further comprised with a living hinge (230) and a channel (212) along one side of the pair of side rails and a set of inter-lockable male and female snaps (235) along the entire length of the opposite side of the pair of side-rails wherein on each of the snap sides is further comprised with a set of teeth flaps (225) configured to engage with a pusher (220) and wherein the bottom cup (240) is further comprised with a slot (270) opening; (b). the pusher (220) for forcing the ammunition from the top end of the side-rails toward the bottom cup (240) of the side-rails, the pusher further comprised with a sliding end configuration (222) to engage the channel (212) of the pair of sliding rails, an open aperture (224) to engage the snaps (235) of the pair od sliding rails, a saddle (226) for a thumb of an operator to move the pusher, a flat member (229) and a strengthening rib (228); and (c). a removable tab (260) to be placed in the slot opening (270) of the bottom cup (240) for partial loading of a magazine (70) wherein the ammunition packaging and loading device (200) called a "Pack and Load" utilize the pusher (220) and rapidly fill the magazine (70) with ammunition rounds (120).

The alternative embodiment of an Internal locking/latching magazine device 30 and coupling ammunition container called a "Lock and Load" is comprised of (a) an exterior case 71 of a traditional magazine 70 and a spring 72 of traditional magazine; (b) a modified follower 75A (without stop post 76); (c) a trigger component 40 further comprised of a top plate 41, a trigger post 42, a flat 44 for latching of the trigger component 40 to a base plate feature 63, and an aperture 46 to connect to the spring 72; (d) a baseplate and trigger guard box 60 further comprised of a slide configuration 61 to slide ably interconnect guard box 60 with magazine case 71, an aperture opening 62 in guard box 60 for trigger post 42, a base plate 63 feature, and a trigger guard box; a push rod component 50; and (e) a contoured to ammunition package 80 further comprised of sidewalls 82, an end 83, a means 84 to secure the sidewalls, a stop/tab with an aperture, and a securing filament 88 attached to the aperture 86 in stop wing/tab 85, and an opening 87 opposite the closed end 83 is contoured for ammunition rounds 120 wherein the Internal locking/latching magazine device and coupling ammunition container called a "Lock and Load" 30 can disengage the spring by using the push rod to force down the ammunition rounds, engaging the trigger to lock with the baseplate and guard and hold the spring in compression so that the ammunition rounds can easily fall from the contoured package and into the magazine, and after the ammunition rounds are in the magazine case, the trigger can be released so the spring re-extends to hold the ammunition rounds against the top opening of the magazine.

Another alternative device is a collar 89 comprised of: (a) a rectangular collar 155 that is configured to lightly press fit and encircle the perimeter of a contoured ammunition package 80 with an open end; (b) a tightening fastener 150 to square the collar 88 with an open end of a traditional ammunition magazine 70 which has an aperture 78 near the open end; and (c) a latch 140 which can removably secure the collar 89 to the aperture 78 at the open end of the ammunition magazine 70 wherein the collar 89 is first placed onto the contoured package 80 then latched to the open end of the magazine 70 at the aperture 78, and then the package 80 is pushed through the collar 89 and into the open end of the magazine 70 thus depressing the spring 72 and releasing ammunition rounds 120 into the magazine 70 and filling the magazine. Still another alternative is the external locking/latching sleeve device 144, 144A comprised of: (a) a load base 152, 152A with and without extended support legs 153 and a tab slot 81; (b) an external latch mechanism 143 attached to the base 152, 152A; (c) a housing 154 connected integrally at one end to the load base 152, 152A and at an opposite end to a cap and plate 157 by fasteners 159; (d) a pusher plate 156 encircling the housing 154; (e) at least one push rod 146 attached at one end to the pusher plate 156 with fasteners 158; (f) an optional horizontal rod 145 attached to the pusher plate 156; and (g) a quick release tab 96 wherein the device 144, 144A is aligned with an ammunition magazine 70 at the open end of the magazine 70, then the latch 143 of the device 144, 144A is engaged with an aperture 78 of the magazine 70, then the push plate 156 with the rods 146 is pressed toward the magazine 70 and a spring 72 of the magazine 70 is depressed as the ammunition rounds 120 begin to release, next the pusher plate reaches the load base 152, 152A and all the rounds 120 are completely released into the magazine thus filling the magazine 70 full of ammunition rounds 120.

The operation of the Pack & Load 200 may be described here: The instructions are as follows: (1) The first thing that will be done is to remove the paper or cellophane wrapper with product description and instructions on it, by tearing it off. (2) The removable tab inside of the cup will be torn away. (3) The cup of the packaging will be inserted on top of the magazine. (4) The pusher will be driven down all the way, completely putting all 30 rounds into the magazine. In addition. If a Partial Fill is desired one: (A) If a magazine has some rounds left in it, a partial fill will be required. (B) If a partial fill is desired, the user can either count each click putting a round in as they are driving down one at a time or one per click. (C) The user can also press the pusher down to a complete stop. The magazine will be filled at this point. One notes that after a partial fill, the removable tab will be placed back inside of the slots securing the remaining rounds.

The alternative embodiment, Internal locking/latching magazine device 30 and coupling ammunition container called a "Lock and Load", operates as follows: Place the rod 50 at the top of the magazine over the follower 76A. Press rod down through magazine until trigger 44 locks with the baseplate 63 through the aperture 62. Place magazine over top of individual rounds 120 in package 80, 90, 100,110. The magazine will pick up rounds 120. The operator 130 keeps pressing over each round individually until magazine is loaded. Press Trigger 40 at the contour 43 to release follower 76A. Magazine is now ready to be used. An alternate way: line package up with top of magazine over the follower 76A. Press package down through magazine until trigger 40 locks. Remove packaging as rounds fall down into magazine. Press Trigger 40 at the contour 43 to release follower 76A. Magazine is ready to use. The contour ammunition package 80 operates as follows: There is a tab 85 that is all that is in slots 86 in the bottom of the packaging 83. The packaging is in a triangle shape to match the bullet rounds 120. The cardboard or metal tab 85 will go through the slots 86 of the packaging. The packaging is inserted down inside the magazine. One then can pull on the filament 88 to remove the tab 85 from the slots 86. The bullet rounds 120 fall down into the magazine. Also if there are rounds left in the packaging when it comes out of a magazine one can re-insert the tab 85 and hold them. There will be a tab at the top of the packaging that will hold the top of the rounds from falling or tumbling back out of the package. The rod in package also include an opening on the bottom of the packaging that will be used to insert the rod up into the packaging and up into the unlocked magazine. This will press a few remaining rounds of ammunition up against the trigger lock. This is a safety feature. If there is only half or less filled package of ammo the tension on the spring can be slowly released by pressing the rod out and through the magazine and packaging. Also for clarification the magazine goes into the packaging the magazine and will simply be pressed in and taken out, no need to be turned upside down. The operation of the external latch devices 89, 144, 144A are described next.

Figure 21:
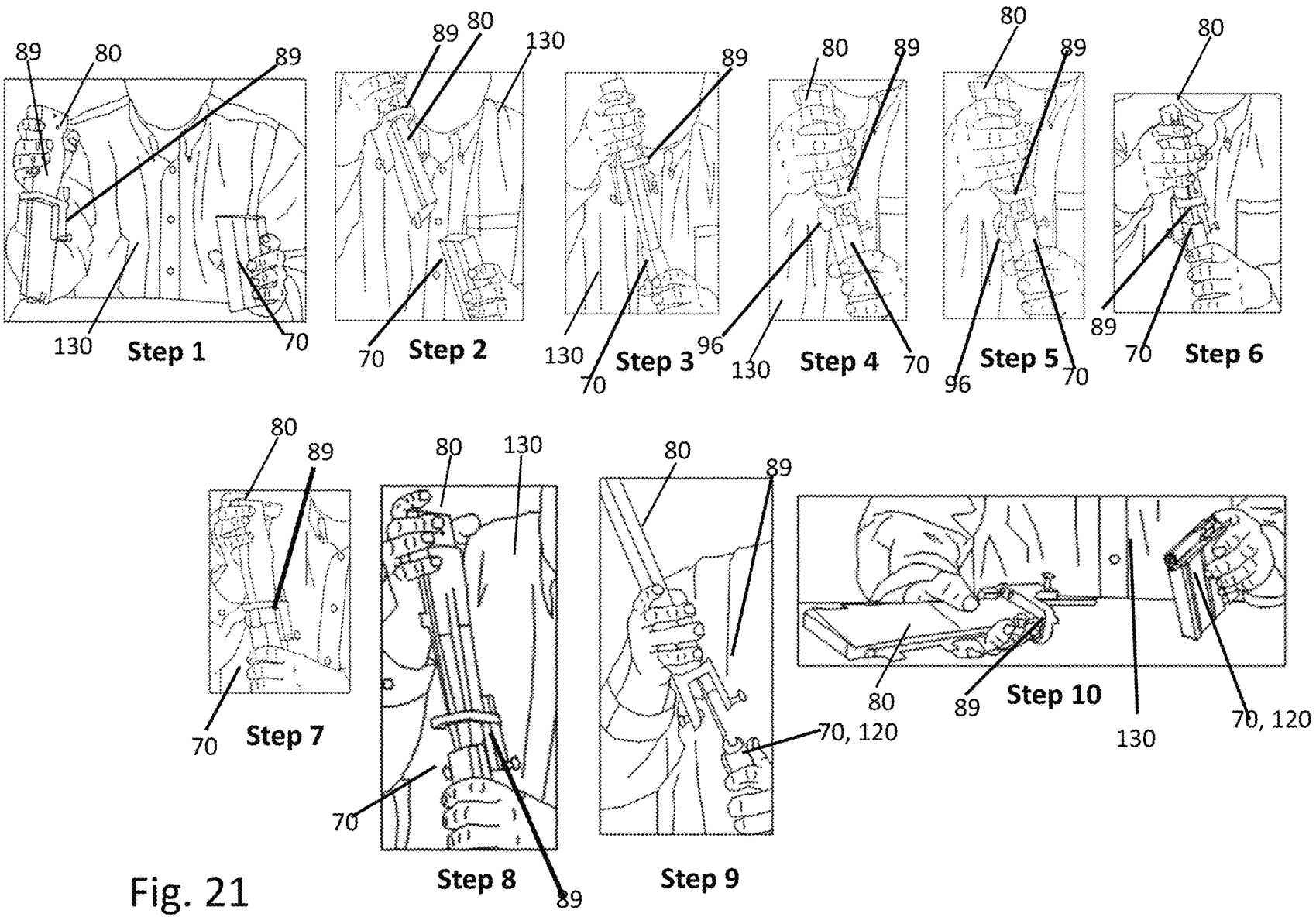
FIG. 21 is a series of sketches showing the steps to load a magazine with the external collar and ammunition sleeve.

FIG. 21 is a series of sketches showing the steps to load ammunition 120 into a magazine 70 with the external collar 89. These are very similar to the ammunition packaging and loading device called a Pack & Load 200. The steps are as follows:

| Step | Description of operating step |
|---|---|
| 1 | An operator 130 places the collar 89 onto a sleeve 80 and presses the collar onto magazine to be locked by the thumb screw 151. He holds it in one hand and obtains a magazine 70 in the other. |
| 2 | Operator 130 aligns collar 89 and sleeve 80 over magazine 70 |
| 3 | Operator 130 engages extension latch 140 into magazine 70 aperture 78 |
| 4 | operator 130 pushes sleeve 80 toward magazine 70, quick tab 96 disengages, and ammunition rounds 120 begin to fill magazine 70 |
| 5 | operator 130 continues to push sleeve 80 and |

-continued

| Step | Description of operating step |
|---|---|
| | quick tab 96 falls away |
| 6 | collar 89 bottoms out and is contiguous to magazine 70 |
| 7 | operator 130 begins to pull/retract sleeve 80 from magazine 70 |
| 8 | operator releases latch 141 from magazine 70 |
| 9 | operator 130 pulls sleeve 80 and collar 89 away from filled magazine 70, 120 |
| 10 | sleeve 80 and collar 89 are separated from filled magazine 70, 120 |

Figure 22:
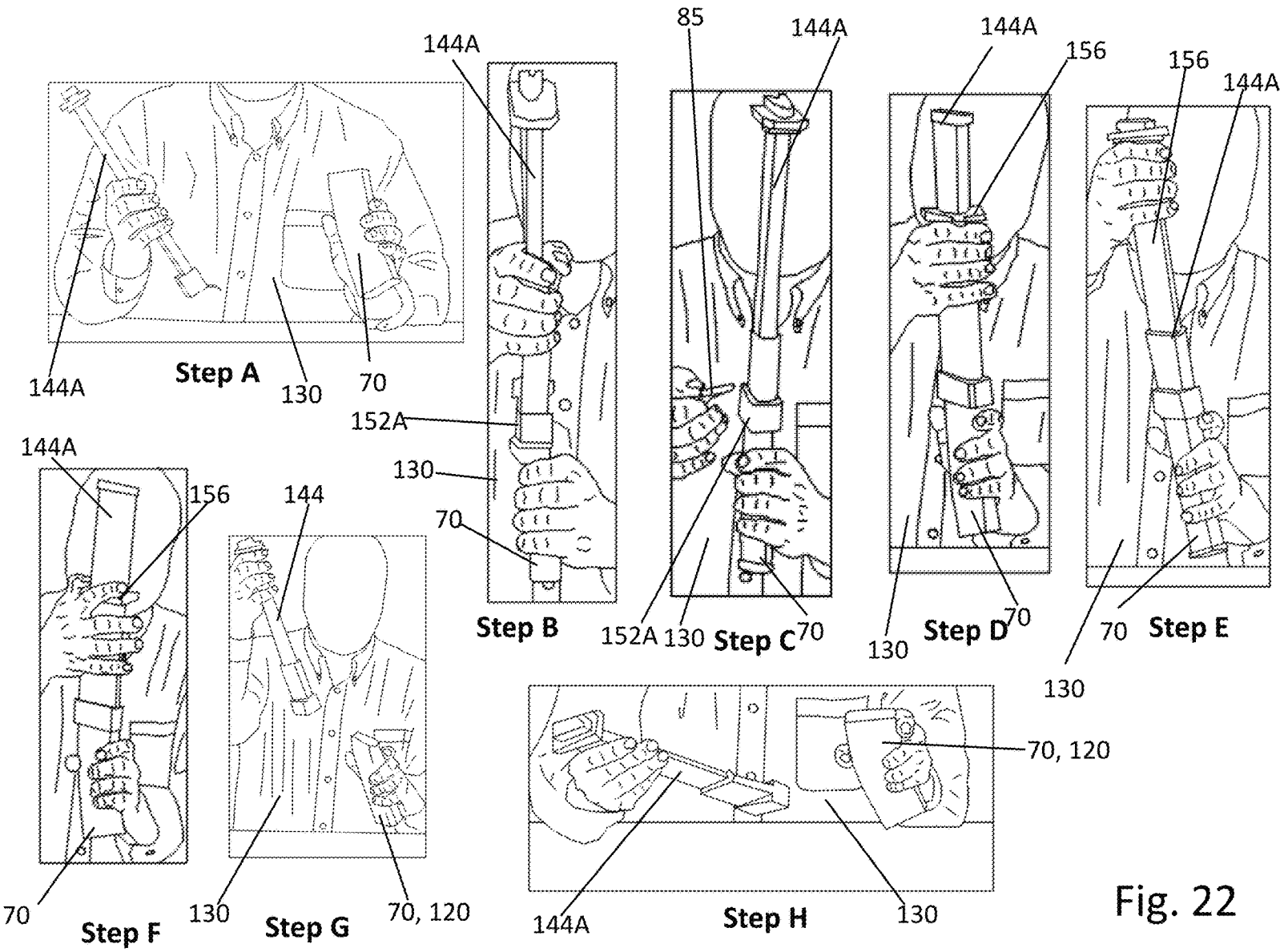
FIG. 22 is a series of sketches showing the steps to load a magazine with the external loading sleeve loaded with ammunition into a banana magazine.

FIG. 22 is a series of sketches showing the steps to load a magazine with the external loading sleeve 144, 144*a* loaded with ammunition 120 into a banana magazine 70. These also are very similar to the ammunition packaging and loading device called a Pack & Load 200.

| Step | Description of operating step |
|---|---|
| A | Operator 130 has external sleeve device 144A and magazine 70 ready to load ammunition 120 from device |
| B | operator aligns device 144A with magazine 70 and engages load base 152A with top/open end of magazine 70 |
| C | operator 130 removes tab 85 from ammunition sleeve device 144A |
| D | operator 130 engages latch 143 into magazine aperture 78 |
| E | operator 130 begins to push/force pusher plate 156 toward magazine 70 forcing ammunition 120 into magazine opening |
| F | operator 130 bottoms out pusher plate 156 against load base 152A and magazine 70 |
| G | operator nudges/releases latch 143 and pulls sleeve device 144A away from magazine 70 and ammo rounds 120 |
| H | external ammunition sleeve device 152A and full magazine 70 with thirty rounds 120 are separated |

FIGS. 23 A through 23 C are sketches of Pack & Load device 200 with the wrapper 290 and comparison to typical ammunition boxes 300. Shown here are the following: a Pack & Load ammunition packaging and loading device 200 holding thirty ammunition rounds 120; a wrapper 290 for Pack & Load ammunition packaging and loading device 200; a set of instructions 292 on wrapper 290; a printed target 294 on wrapper with means such as sticky tabs to attach target to flat surface; and a typical and traditional twenty round ammunition box 300. The packaging can be used as a dispenser. In the case where a user does not have a double stacked opening magazine, the user can simply dispense the number of rounds they want out into their hand. This will be faster than removing them out of a box. The rounds will come out of the Pack & Load Packaging into the users hand lined up with cap and bullet facing the correct way. Also there is shown the size advantage. Pack & Load 200 can put sixty rounds in the same space that most traditional packages can only get 40. For shipping and store shelves, this will be an advantage to save space and money. The wrapper 290 contains all of the directions and information 292 for the Pack & Load packaging 200. There is also a free printed target 294 that shooters can use in practice.

Many types of ammunition rounds are anticipated to be used with the ammunition packaging and loading device 200 called a Pack & Load and the Internal and external locking/latching magazine devices 30, 89, 144, 144A and coupling ammunition container called a "Lock and Load". As of now, there are no known common rounds of ammunition 120 that are not usable with a similar system 30, 89, 144, 144A. With this description it is to be understood that the ammunition packaging and loading device 200 called a Pack & Load and the Internal and external locking/latching magazine devices 30, 89, 144, 144A and coupling ammunition container called a "Lock and Load" is not to be limited to only the disclosed embodiment of product. The features of the ammunition packaging and loading device 200 called a Pack & Load and the Lock and Load devices 30, 89, 144, 144A are intended to cover various modifications and equivalent arrangements included within the spirit and scope of the description.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described above in the foregoing paragraphs.

Other embodiments of the invention are possible. Although the description above contains much specificity, these should not be construed as limiting the scope of the invention, but as merely providing illustrations of some of the presently preferred embodiment's of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

What is claimed is:

1. An ammunition packaging and loading device (200) made of durable materials and called a Pack and Load is comprised of:

(a). pair of mirror imaged side rails (210) each of the pair of side rails with a left and right side and a top pushing end and a bottom cup (240) end and each of the pair further comprised with a living hinge (230) and a channel (212) along one side of the pair of side rails and a set of inter-lockable male and female snaps (235) along the entire length of the opposite side of the pair of side-rails wherein on each of the snap sides is further comprised with a set of teeth flaps (225) configured to engage with a pusher (220) and wherein the bottom cup (240) is further comprised with a slot (270) opening;

(b). the pusher (220) for forcing the ammunition from the top end of the side-rails toward the bottom cup (240) of the side-rails, the pusher further comprised with a sliding end configuration (222) to engage the channel (212) of the pair of sliding rails, an open aperture (224) to engage the snaps (235) of the pair od sliding rails, a saddle (226) for a thumb of an operator to move the pusher, a flat member (229) and a strengthening rib (228); and (c). a removable tab (260) to be placed in the slot opening (270) of the bottom cup (240) for partial loading of a magazine (70)

wherein the ammunition packaging and loading device (200) called a "Pack and Load" utilize the pusher (220) and rapidly fill the magazine (70) with ammunition rounds (120).

2. The ammunition packaging and loading device (200) according to claim 1 wherein the bottom cup (240) is further comprised with bottom brushes (250) which resist and hold ammunition rounds (120) during a fill process.

3. The ammunition packaging and loading device (200) according to claim 1 wherein the top end of the side rails (210) are further comprised with top brushes (255) which can resist and hold a brass piece during a clean-up process.

4. The ammunition packaging and loading device (200) according to claim 1 wherein the pusher (220) is further comprised of a pin (221) which can be used when field dressing an AR rifle.

5. The ammunition packaging and loading device (200) according to claim 1 wherein the bottom cup (240) is further configured with a tight interference fit to engage a magazine (70) during a loading process.

6. The ammunition packaging and loading device (200) according to claim 1 wherein the durable material for the side rails is selected from the group consisting of poly polypropylene plastic, polyurethane plastic, non-reinforced plastic, compressed cardboard, compressed fiber boards, and biodegradable composite materials.

7. The ammunition packaging and loading device (200) according to claim 1 wherein the durable material for the cup is selected from the group consisting of is selected from the group consisting of polyurethane plastic, aluminum, steel, steel alloys, brass, plastic, reinforced plastic, and composite materials.

8. The ammunition packaging and loading device (200) according to claim 1 wherein the durable material for the pusher is selected from the group consisting of aluminum, steel, steel alloys, brass, plastic, reinforced plastic, and composite materials.

9. The ammunition packaging and loading device (200) according to claim 1 further comprised of a wrapper.

10. The ammunition packaging and loading device (200) according to claim 9 further comprised of a target imprinted on the wrapper.

11. The ammunition packaging and loading device (200) according to claim 9 wherein the wrapper material is selected from the group consisting of paper, cardboard, cellophane, and composite material.

* * * * *